US008020938B2

(12) United States Patent
Glöckl et al.

(10) Patent No.: US 8,020,938 B2
(45) Date of Patent: Sep. 20, 2011

(54) CHAIR OR STOOL COMPRISING MOBILE, ELASTIC LEGS, PERMITTING A DYNAMIC SITTING POSITION

(76) Inventors: Josef Glöckl, Kirchheim (DE); Thomas Walser, Gattingen (CH)

( * ) Notice: Subject to any disclaimer, the term of this patent is extended or adjusted under 35 U.S.C. 154(b) by 914 days.

(21) Appl. No.: 10/568,891

(22) PCT Filed: Aug. 12, 2004
(Under 37 CFR 1.47)

(86) PCT No.: PCT/EP2004/009056

§ 371 (c)(1),
(2), (4) Date: Aug. 22, 2008

(87) PCT Pub. No.: WO2005/018384

PCT Pub. Date: Mar. 3, 2005

(65) Prior Publication Data

US 2009/0200845 A1 Aug. 13, 2009

(30) Foreign Application Priority Data

Aug. 19, 2003 (DE) ..... 103 38 549

(51) Int. Cl.

| | |
|---|---|
| ***A47C 9/00*** | (2006.01) |
| ***A47C 1/00*** | (2006.01) |
| ***A47C 7/00*** | (2006.01) |
| ***A47B 91/00*** | (2006.01) |
| ***A47B 91/16*** | (2006.01) |

(52) U.S. Cl. ..... 297/461; 297/195.11; 297/313; 297/314; 297/423.1; 248/188.3; 248/188.6; 248/188.7; 248/188.8

(58) Field of Classification Search ..... 297/195.11, 297/313, 314, 423.1, 461; 248/188.6, 188.7, 248/188.8
See application file for complete search history.

(56) References Cited

U.S. PATENT DOCUMENTS

| | | | | | |
|---|---|---|---|---|---|
| 282,371 | A | * | 7/1883 | Rintelman | 297/461 |
| 476,805 | A | * | 6/1892 | Mason | 297/461 |
| 713,639 | A | * | 11/1902 | Herbert | 297/461 |
| 760,260 | A | * | 5/1904 | Schultz | 297/461 |
| 816,158 | A | * | 3/1906 | Erickson | 297/461 |
| 816,905 | A | * | 4/1906 | Erickson | 297/461 |
| 1,408,581 | A | * | 3/1922 | Gaudreau et al. | 297/461 |
| 1,477,652 | A | * | 12/1923 | Koenig | 297/461 |
| 1,565,636 | A | * | 12/1925 | Goetz | 297/461 |
| 3,262,406 | A | * | 7/1966 | Nickolaisen | 297/461 |
| 3,278,147 | A | * | 10/1966 | Olander | 248/188.3 |
| 3,653,715 | A | * | 4/1972 | Drabert et al. | 297/461 X |
| 4,053,129 | A | * | 10/1977 | Graff | 248/188.7 |
| 4,183,579 | A | * | 1/1980 | Gonzalez y. Rojas | 297/195.11 |
| 4,262,871 | A | * | 4/1981 | Kolk et al. | 248/188.7 |
| 4,699,344 | A | * | 10/1987 | Vaughan | 248/188.7 X |
| 4,932,719 | A | * | 6/1990 | Gonzalez y. Rojas | 297/195.11 X |
| 5,524,967 | A | * | 6/1996 | Glockl | 297/314 |
| 5,690,303 | A | * | 11/1997 | Winters | 248/188.7 X |
| 5,738,326 | A | * | 4/1998 | Liao | 297/461 X |
| 5,842,742 | A | * | 12/1998 | Hoshino | 297/461 X |
| 5,909,925 | A | * | 6/1999 | Glockl | 297/314 |

(Continued)

*Primary Examiner* — Rodney B White
(74) *Attorney, Agent, or Firm* — Harness, Dickey & Pierce, PLC

(57) ABSTRACT

The disclosure relates to a chair comprising a seat part, at least one leg part, at least one foot part that consists of a predetermined plurality of foot elements and at least one spring assembly. According to the disclosure, at least one designated foot element and/or a sub-section of said element is configured to be mobile and is subject to a restoring moment under the action of a load.

10 Claims, 35 Drawing Sheets

Figure 1A:
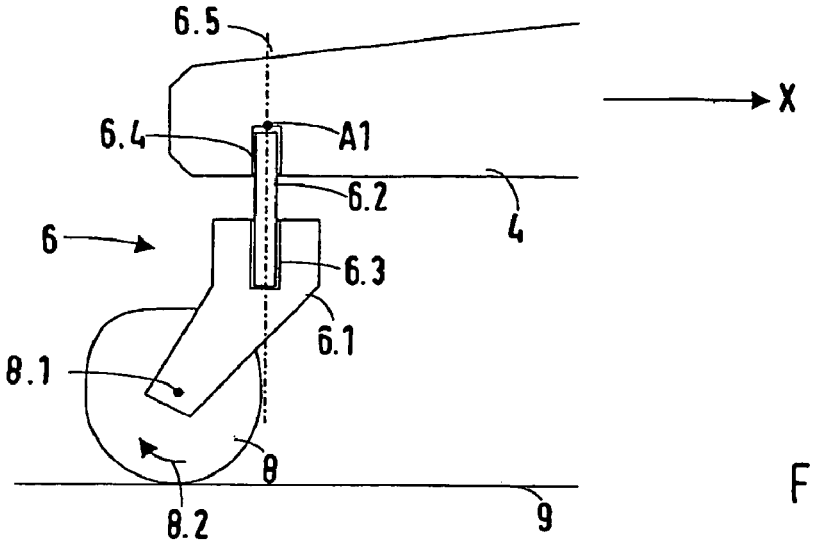

U.S. PATENT DOCUMENTS 6,003,944 A * 12/1999 Glockl ..... 297/313 X
6,030,045 A * 2/2000 Hoshino ..... 297/461
6,059,239 A * 5/2000 Wheeler ..... 248/188.7
6,095,464 A * 8/2000 du Rees ..... 248/188.7
6,106,064 A * 8/2000 Hibberd ..... 297/314
6,672,660 B2 * 1/2004 Hoshino ..... 297/195.11 X
6,709,052 B2 * 3/2004 Jalkanen ..... 297/195.11 X
7,219,956 B2 * 5/2007 Zhang ..... 297/195.11
7,234,781 B2 * 6/2007 Liao ..... 297/461
7,547,067 B2 * 6/2009 Keilhauer et al. ..... 297/313
7,618,090 B2 * 11/2009 Grenon ..... 297/195.11
2003/0151291 A1 * 8/2003 Lin et al. ..... 297/461 X
2007/0102979 A1 * 5/2007 Tedesco ..... 297/423.1 X

* cited by examiner

A-A

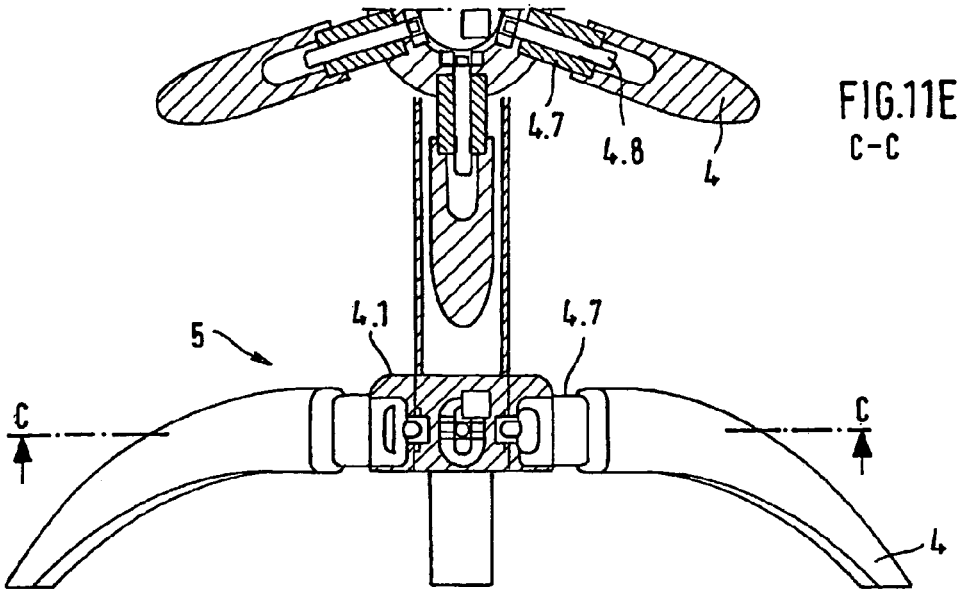
FIG.11E
C-C
FIG.11D
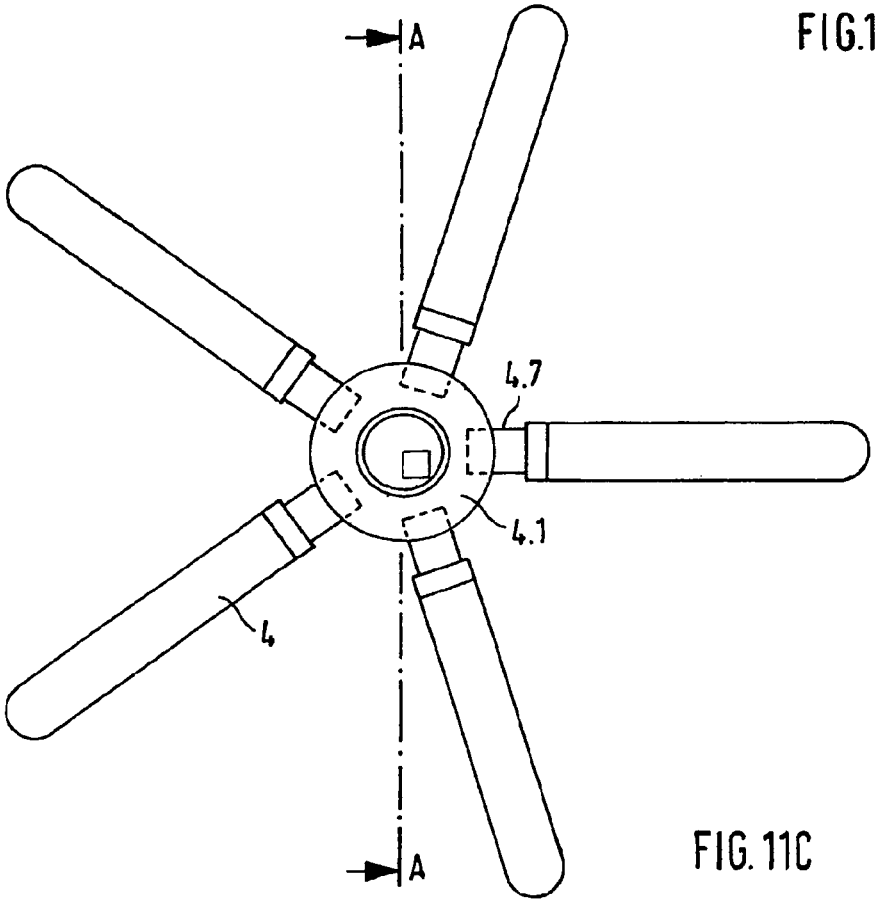
FIG. 11C

A-A

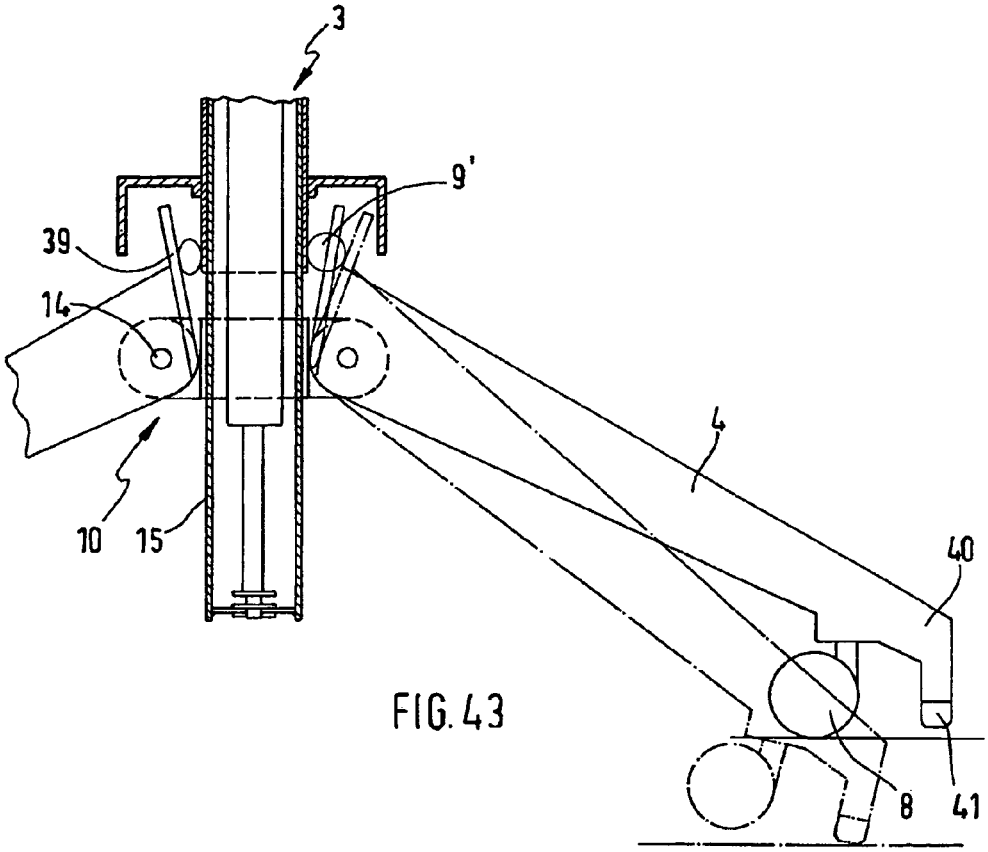
FIG. 43
FIG. 44
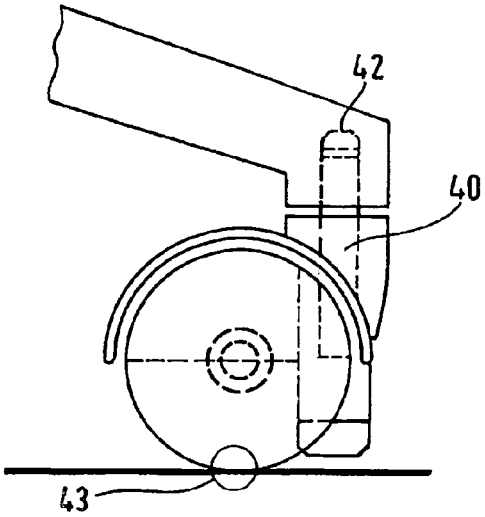
FIG. 45
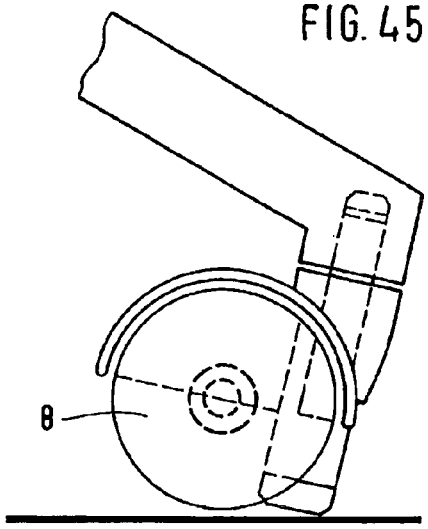

CHAIR OR STOOL COMPRISING MOBILE, ELASTIC LEGS, PERMITTING A DYNAMIC SITTING POSITION

The invention relates to chairs with a foot part comprising at least three mobile, spring-mounted foot elements that are connected to a leg part of the chair.

The priority of German patent application DE 10338549.1 is claimed, which was submitted on Aug. 19, 2003 and bears the title "Rocker Seat".

Office chairs are frequently provided with a star-shaped foot part at the ends of each of which there is a roller. The mobility of an office chair is essentially limited to adjusting the height by means of a gas spring and the spring mounting of the backrest or seat. There are also complex mechanical systems which are costly to produce and in part exceedingly complicated and which only to a limited extent permit a so-called dynamic sitting behavior.

A rocker stool suitable for dynamic sitting behavior is disclosed by European patent application EP 0 808 116. In this rocker stool, the rocking movement is made possible by a rubber element located between the foot part and the leg part. This known rocker stool functions well and fulfills the task of active, dynamic sitting behavior.

A chair is disclosed in WO 01/91615 A1 that is equipped with resilient chair feet and a weight-centered seat mechanism. In the publication, a five-point-star-shaped foot is disclosed the free ends of which are equipped with rollers that are spring-mounted on a rubber ring. As a further spring mounted system with resilient feet, a circular disk made of spring steel is described instead of a five-point star-shape which permits pivoting and wobbling.

It is an object of the present invention to provide a stool or a chair that permits dynamic sitting behavior and is preferably easy to move.

It is a further object of the present invention to provide a stool or a chair which retains the advantageous properties inherent in the known rocker stool but which is less expensive and easier to manufacture.

Moreover, it is an object of the present invention to provide a simple design configuration of rollable or movable chairs that permits considerably more movement on the part of the user without compromising safety and thus avoiding postural deformities that arise due to rigid sitting postures.

It is further desired to provide a chair that allows for safe and comfortable sitting even at a higher level. It should above all be avoided that such a chair can suddenly tip in exposed positions.

The objects are attained by the teachings disclosed in the independent claims 1 and 2.

According to the invention, a chair is provided with a preferred embodiment that has several support elements in the area of the foot elements which are arranged on an resiliently acting foot part of the chair. When the chair is under load, there is a lowering movement of the chair and at least one of the support elements shifts relative to a floor surface.

To achieve this, foot elements of the chair can either be spring mounted or they can be resilient in design with respect to the material and/or construction. A combination of a spring mounting with resiliently designed foot elements is also possible.

Advantageously, in a special embodiment, a desired return force over the subranges of the 360 degree turning range of the foot part can be set such that, for example, unintentionally severe rocking backwards can be reduced by a greater return force.

A chair according to the invention permits an upward and downward movement during sitting by means of the user of an resiliently acting foot part that provides dynamic relief of the spinal column. A chair according to the invention also has a supporting effect when standing up and sitting down. Shocks to the spinal column, for example, are thereby dampened when sitting down. The up and down motion is achieved without a special vertically arranged spring element, for example, in the form of a coil spring, being required in the foot part of the chair, simply through the spring mounting, or the elasticity of the foot elements Since new ergonomic findings place considerably higher demands on the variability as well as the flexibility of the chairs, the present invention provides solutions for dynamic sitting on chairs. The present invention is in particular suited to use in chairs that have supporting elements (rollers, gliders or similar elements).

It is an advantage of the invention that the corresponding chairs allow an active rocking/tilting motion that is healthy.

It is another advantage of the invention that the corresponding chairs can be used flexibly, are movable and still safe.

The invention, depending on the embodiment, is suitable for simple retro-fitting of existing office chairs.

Advantageous is an embodiment with a star-shaped foot element arrangement in which the foot elements and/or a sub-section therefrom is spring-loaded and can be pivoted up and down, whereby it is possible in each case to predetermine the loaded direction by means of the rocking movement through corresponding spring diameters.

Advantageous is an embodiment in which in the lower section of at least one leg part at least one supporting section is formed on which at least one of the foot elements is accommodated. This supporting part can be designed advantageously in such a way that a foot element is pivoted to it, wherein a counterpart holds this foot element in position.

Advantageous is an embodiment in which at least one spring arrangement is formed at one counterpart which alternatively hereto, however, can also be formed on the seat. The spring arrangement may thereby consist advantageously of a piece of elastomer material against which a section of the foot element or of the sub-section resiliently adjoins.

Another embodiment may be provided with a spring arrangement which consists of a tension or a compression spring which is arranged on a leg part or on a supporting part and which is operative between at least one foot element and the leg part or the supporting part.

An adjusting device is provided for advantageously on the spring arrangement to adjust the spring force.

It may be advantageous to have a support means arranged on the side toward the leg of the foot element to which at least one spring element of the spring arrangement acts.

It may be advantageous that at least one slot that opens downward be formed at the end facing toward the leg of at least one of the foot elements. It can hereby be advantageously achieved that the foot element can simply be secured, and it can be desirably provided for that the foot element can pivot downward and at least is mountable by simply being placed thereon in the down pivoted position.

It may be advantageous to provide means to prevent uncontrolled translators motion of the chair during the rocking motion.

Particularly advantageous is an embodiment in which the foot part is composed of foot elements that are mounted mechanically in reference to the foot part in such a way that they are acted upon by a spring element with a return force. This return force counteracts an expanding pivotal movement produced by the loading of the chair and attempts to pull the radially outwardly moving foot elements toward a central axis of the chair. Preferrably the return force can be made adjustable or by default.

In a preferred embodiment, the chair has several foot elements at each foot end of which is attached a roller that serves as a supporting element via an angled guide axle.

It may be advantageous to provide means to prevent uncontrolled translatory motion of the rocker stool during the rocking motion.

For this purpose, a means may be provided in the form of a stopper which, at a predetermined inclination of the leg part, comes into contact with the ground and, by virtuae of friction therewith, prevents translatory motion of the rocker stool.

This stopper can also be coupled to the leg part by means of a pivotal connection, it may, however, also be rigidly attached to the leg part and come into contact with the ground at a predetermined inclination of the leg part.

In another embodiment, however, the stopper can also be arranged rigidly at the outer end of the foot and, in relation to a circumferential contour on which all surfaces of the foot that come into contact with the ground are disposed, is radially outside that contour.

Figure 1B:
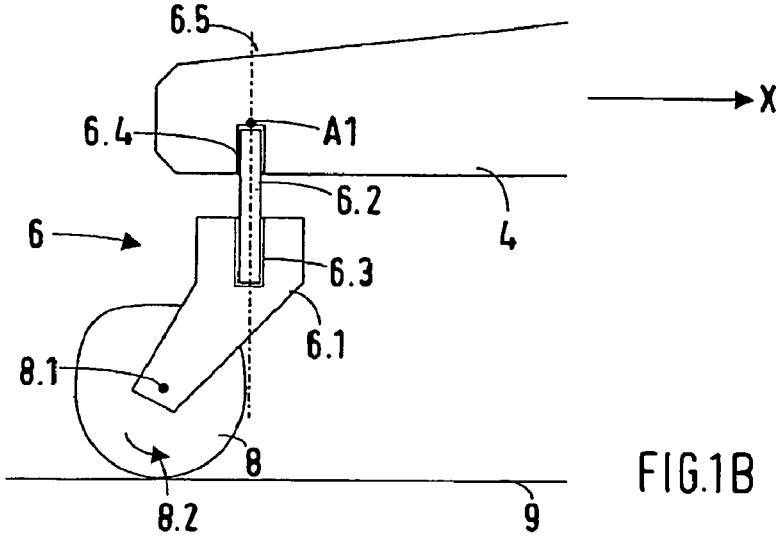
Figure 1C:
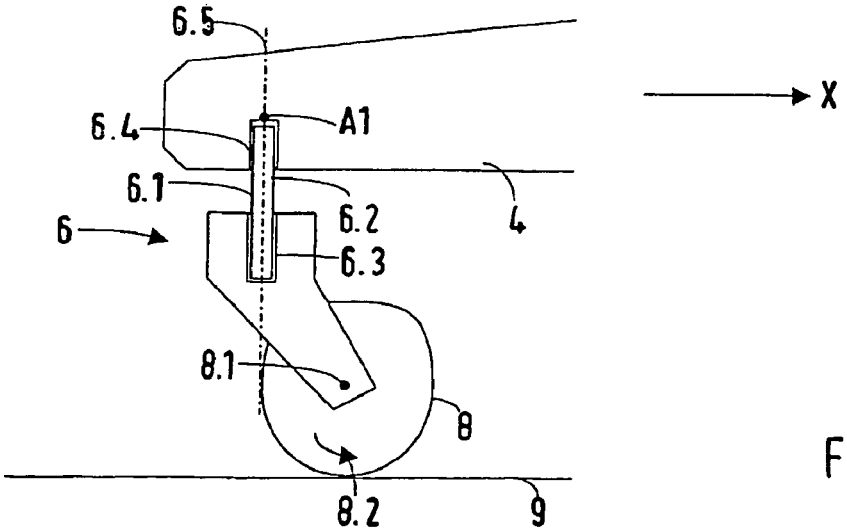
Figure 2A:
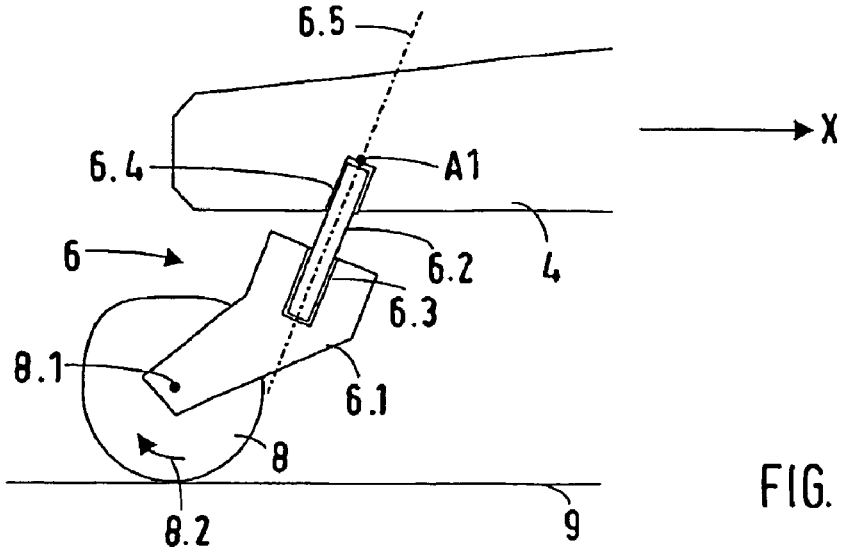
Figure 2B:
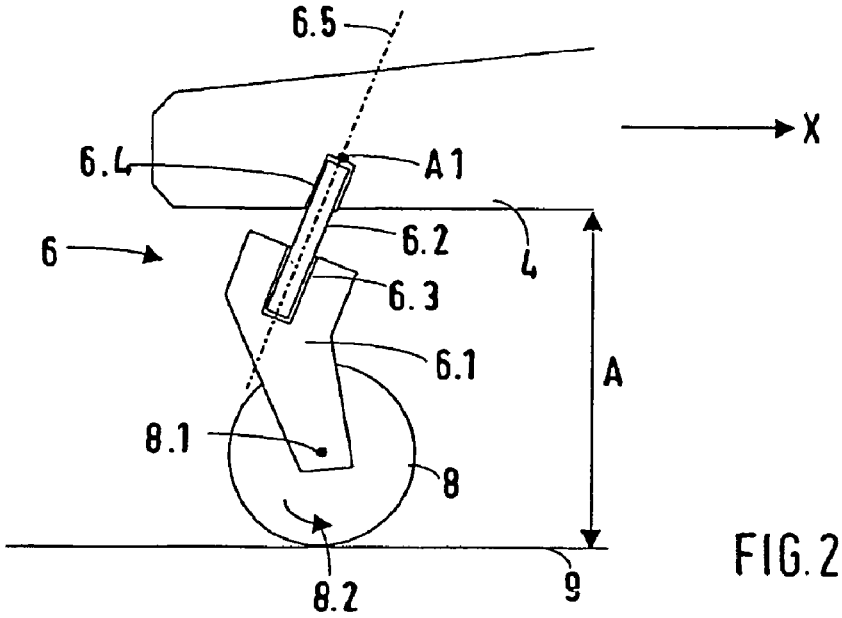
Figure 3:
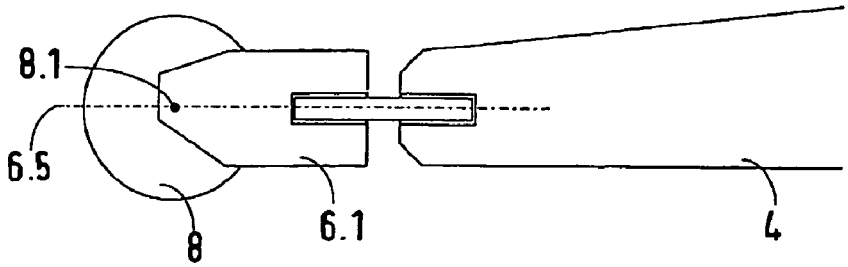
Figure 4A:
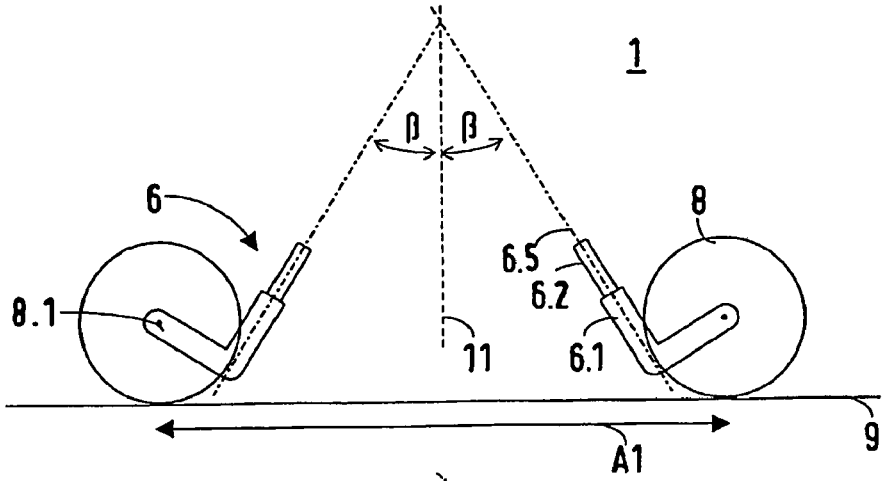
Figure 4B:
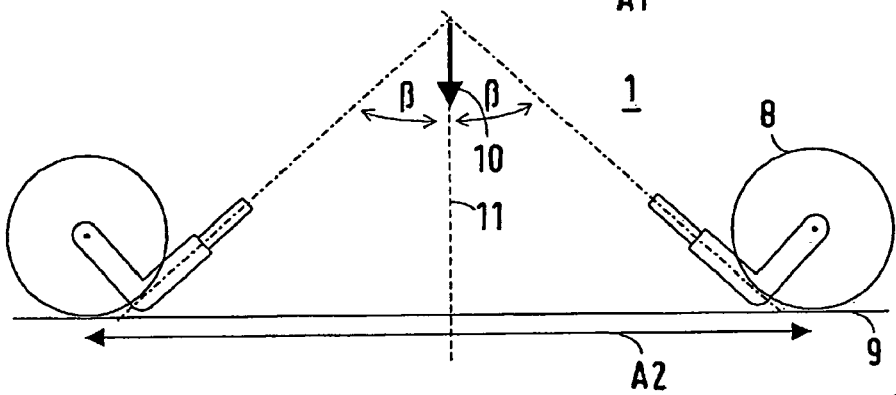
Figure 4C:
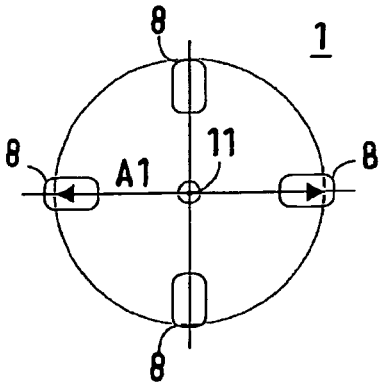
Figure 4D:
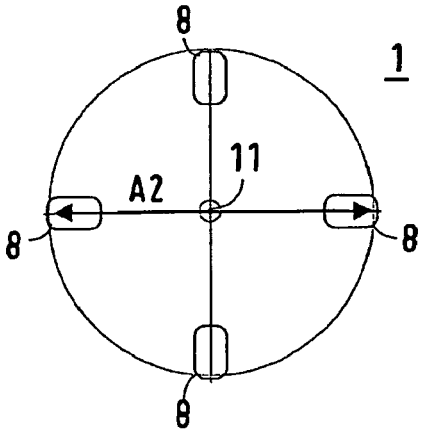
Figure 5A:
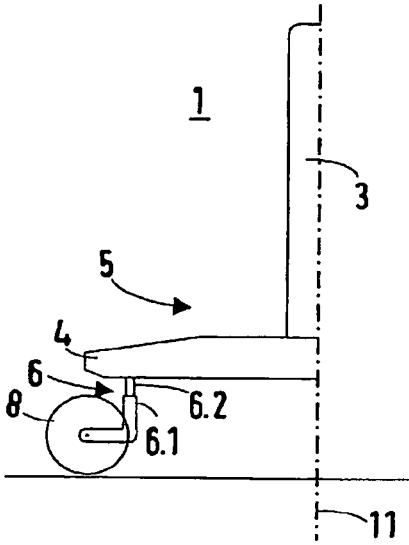
Figure 5B:
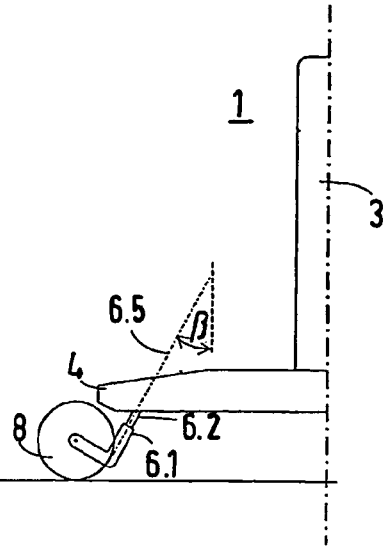
Figure 6A:
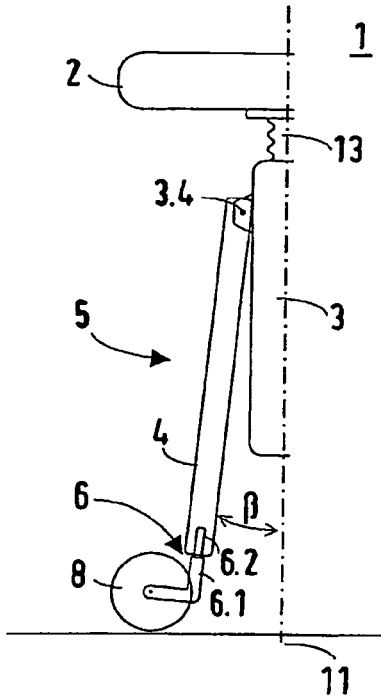
Figure 6B:
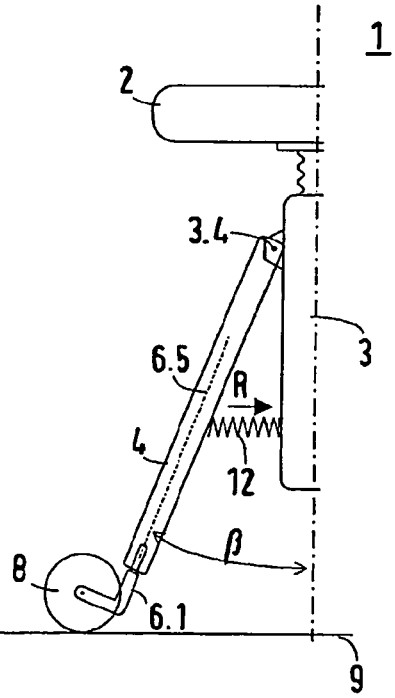
Figure 7A:
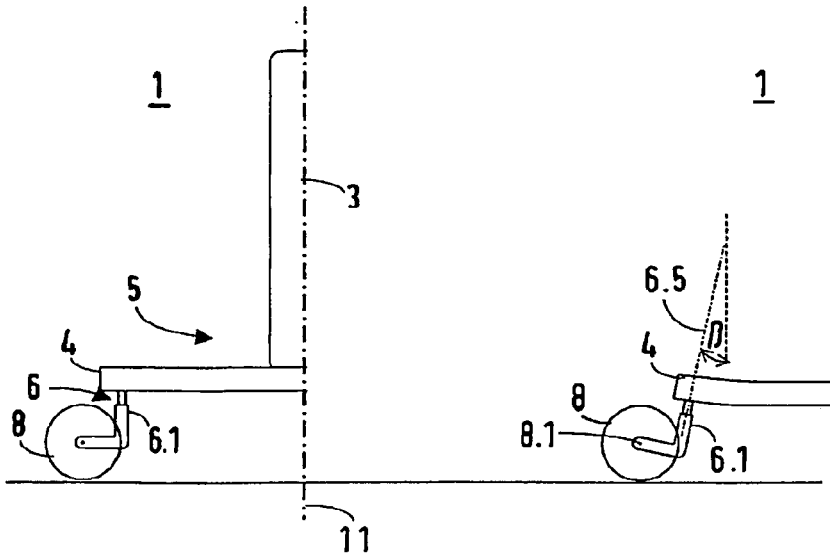
Figure 7B:
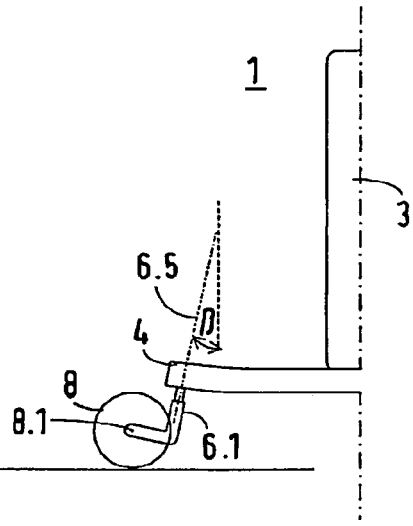
Figure 8A:
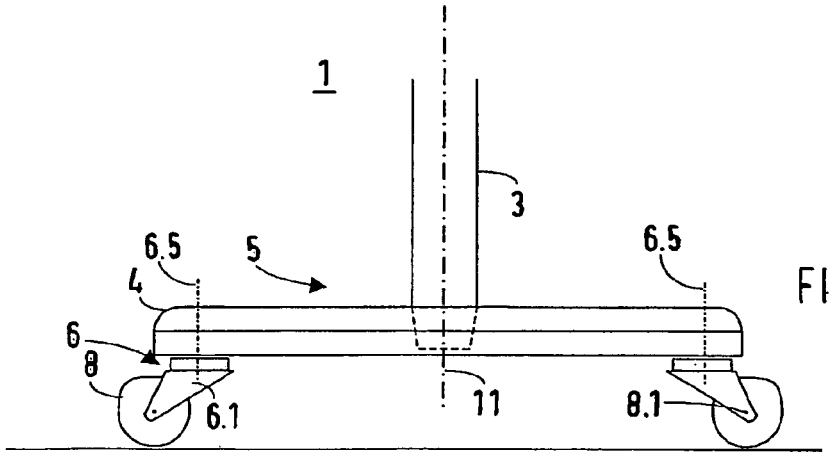
Figure 8B:
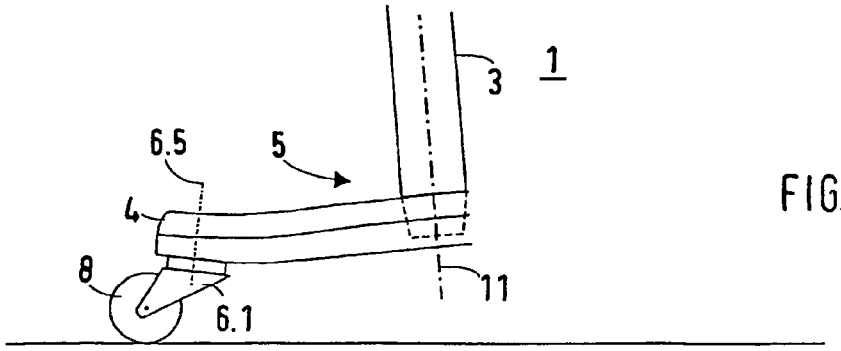
Figure 10A:
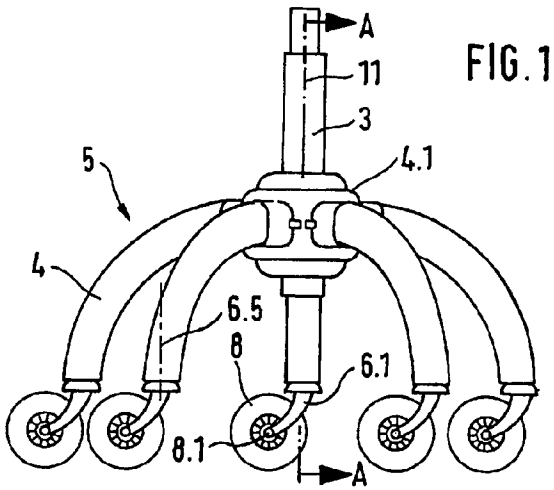
Figure 10B:
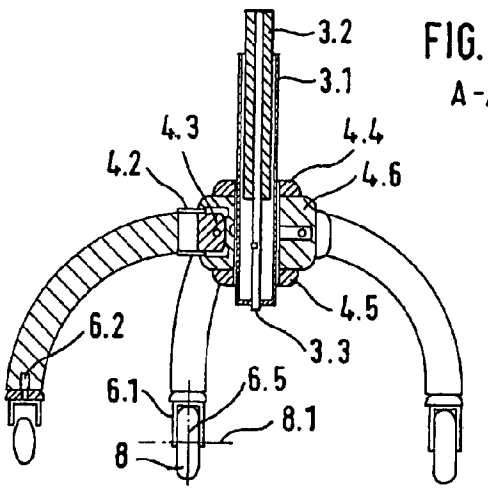
Figure 9:
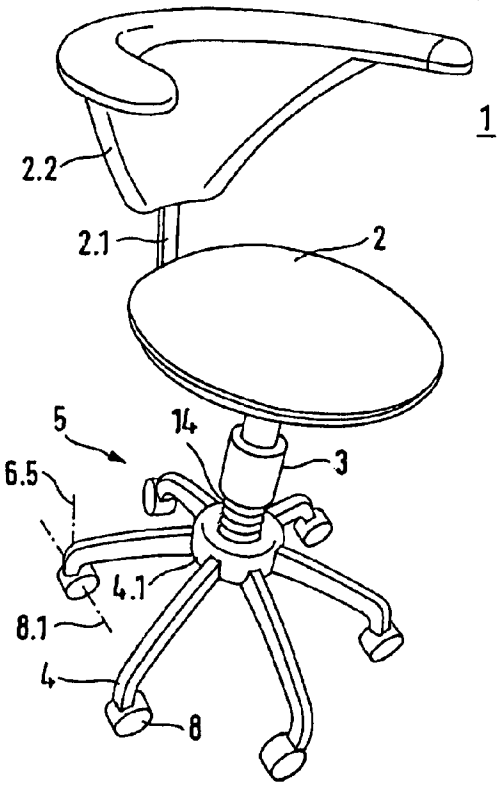
Figure 11B:
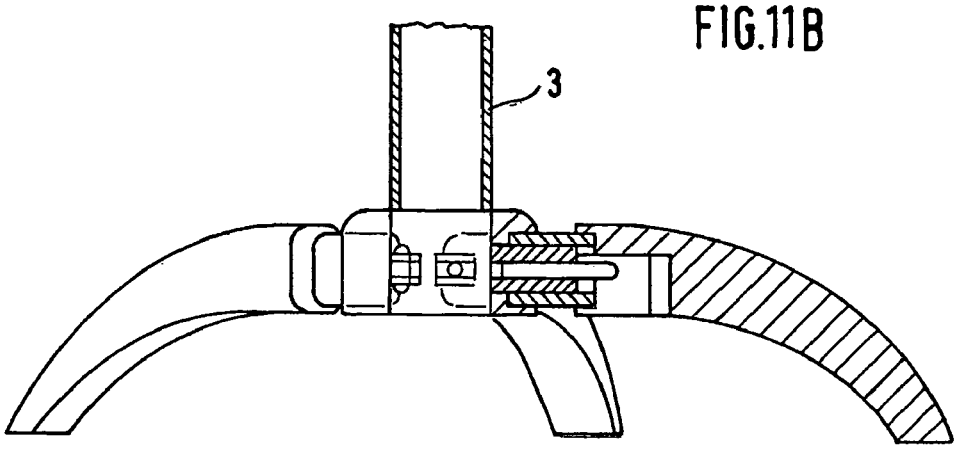
Figure 11A:
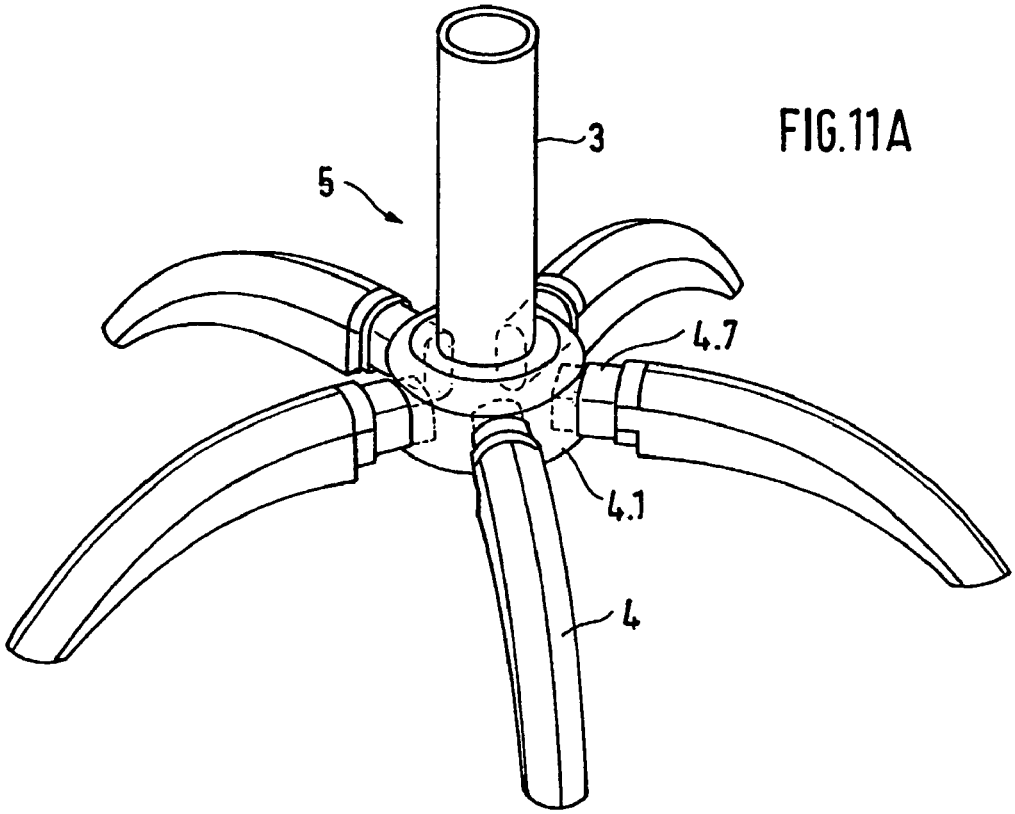
Figure 12A:
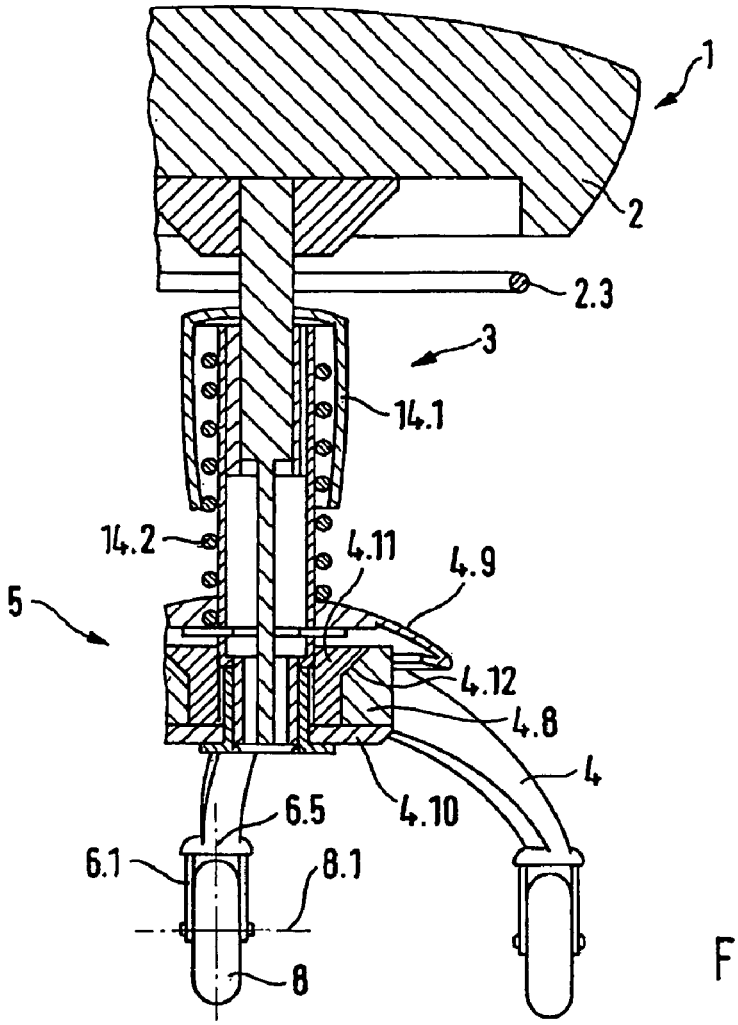
Figure 12B:
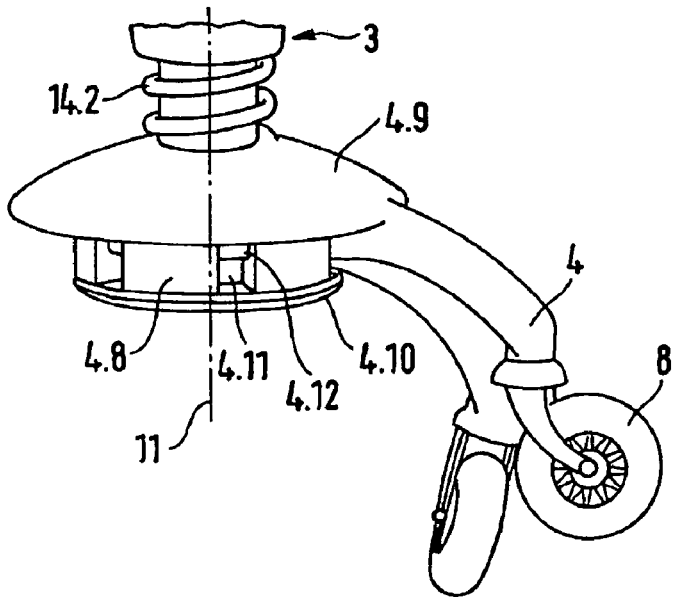
Figure 13:
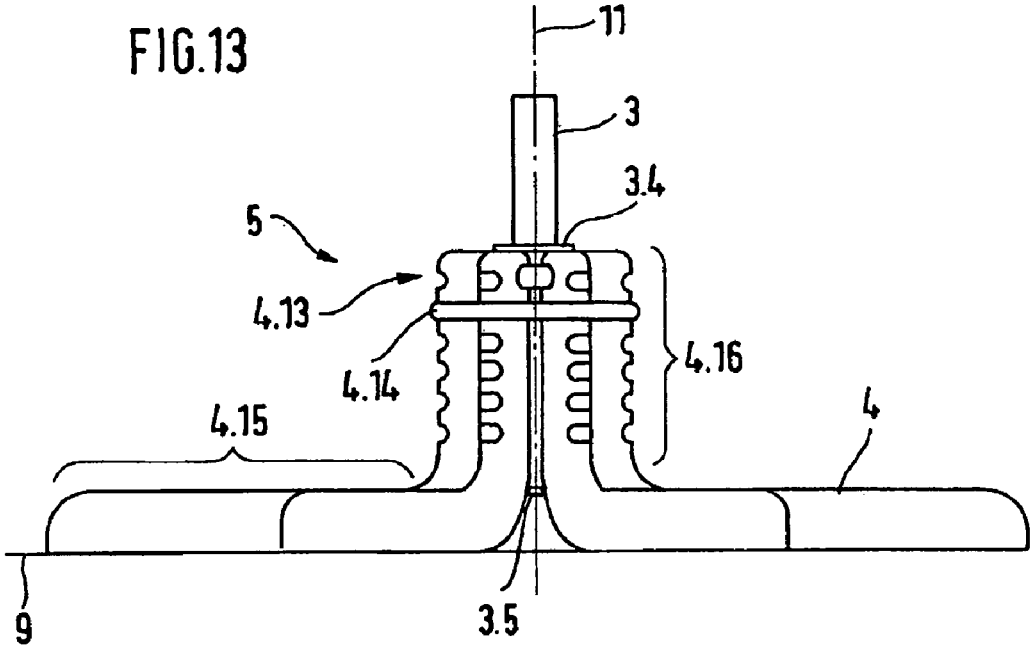
Figure 14:
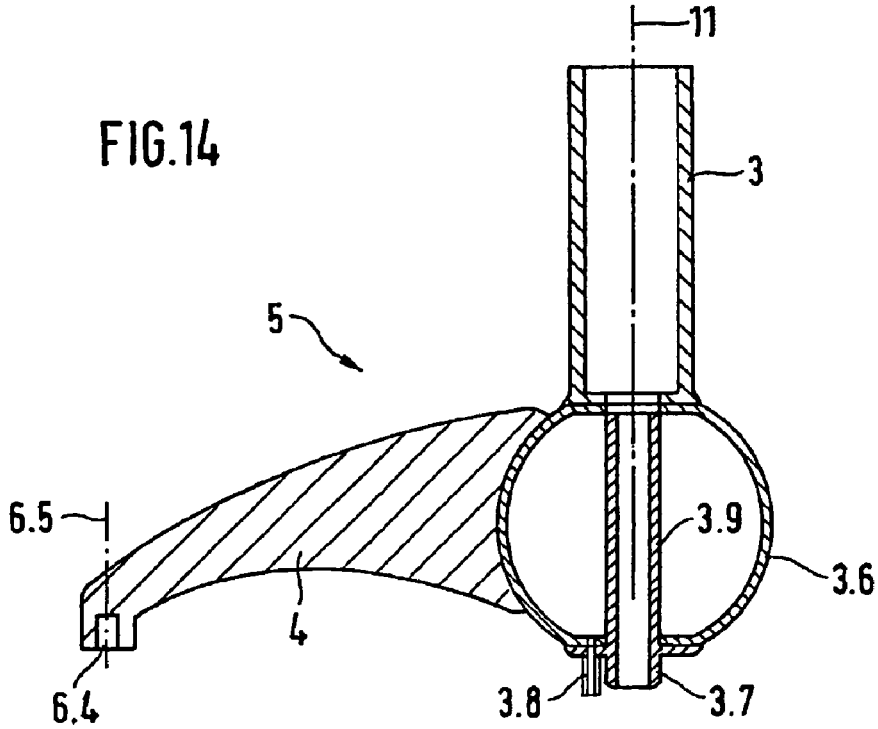
Figure 15:
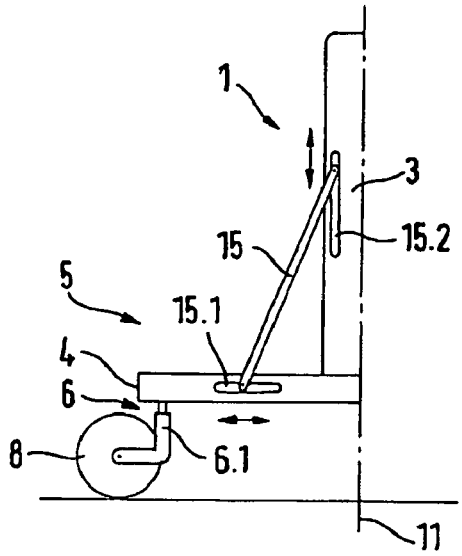
Figure 16:
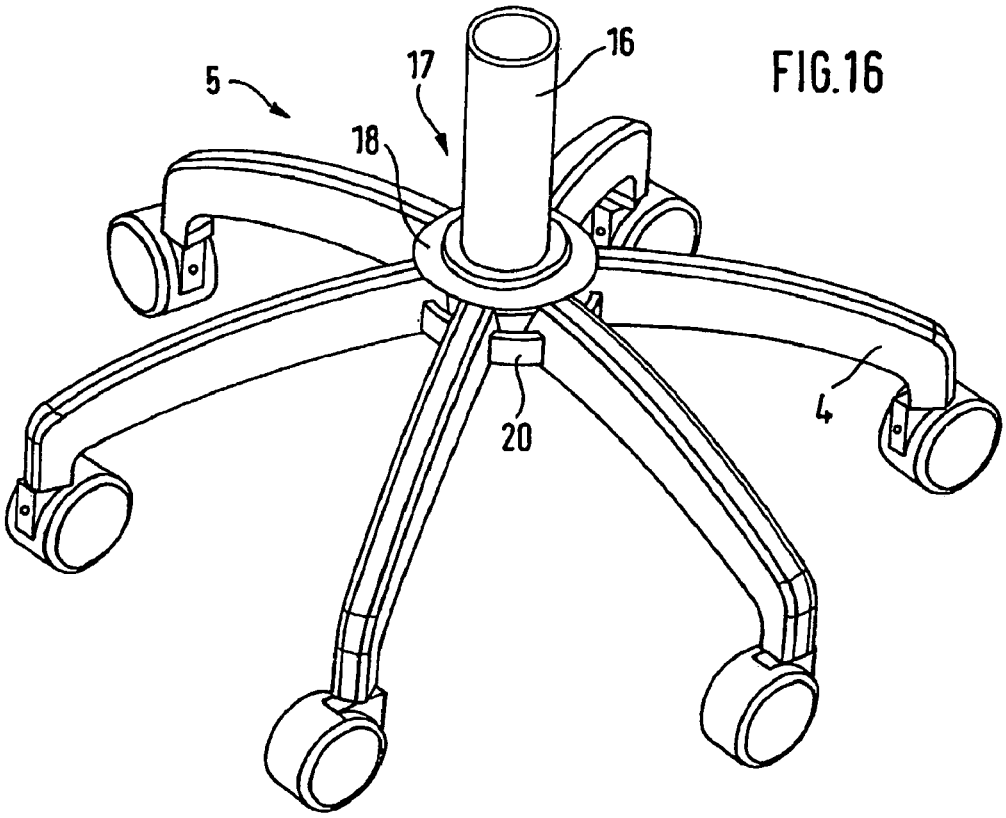
Figure 17:
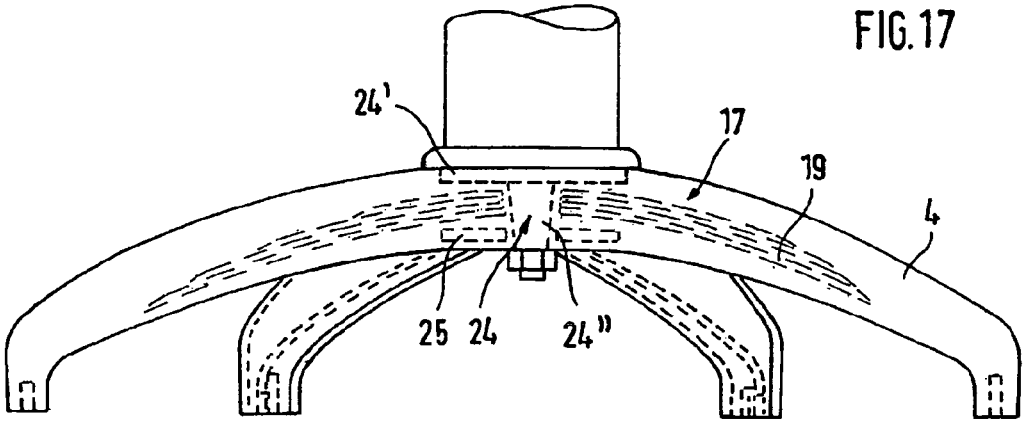
Figure 18:
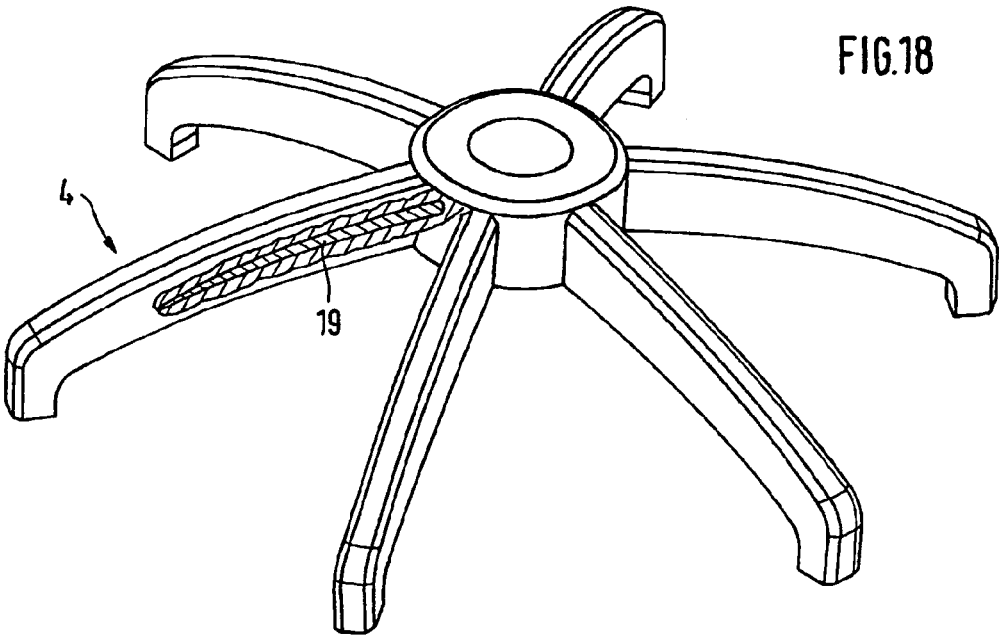
Figures 19, 20:
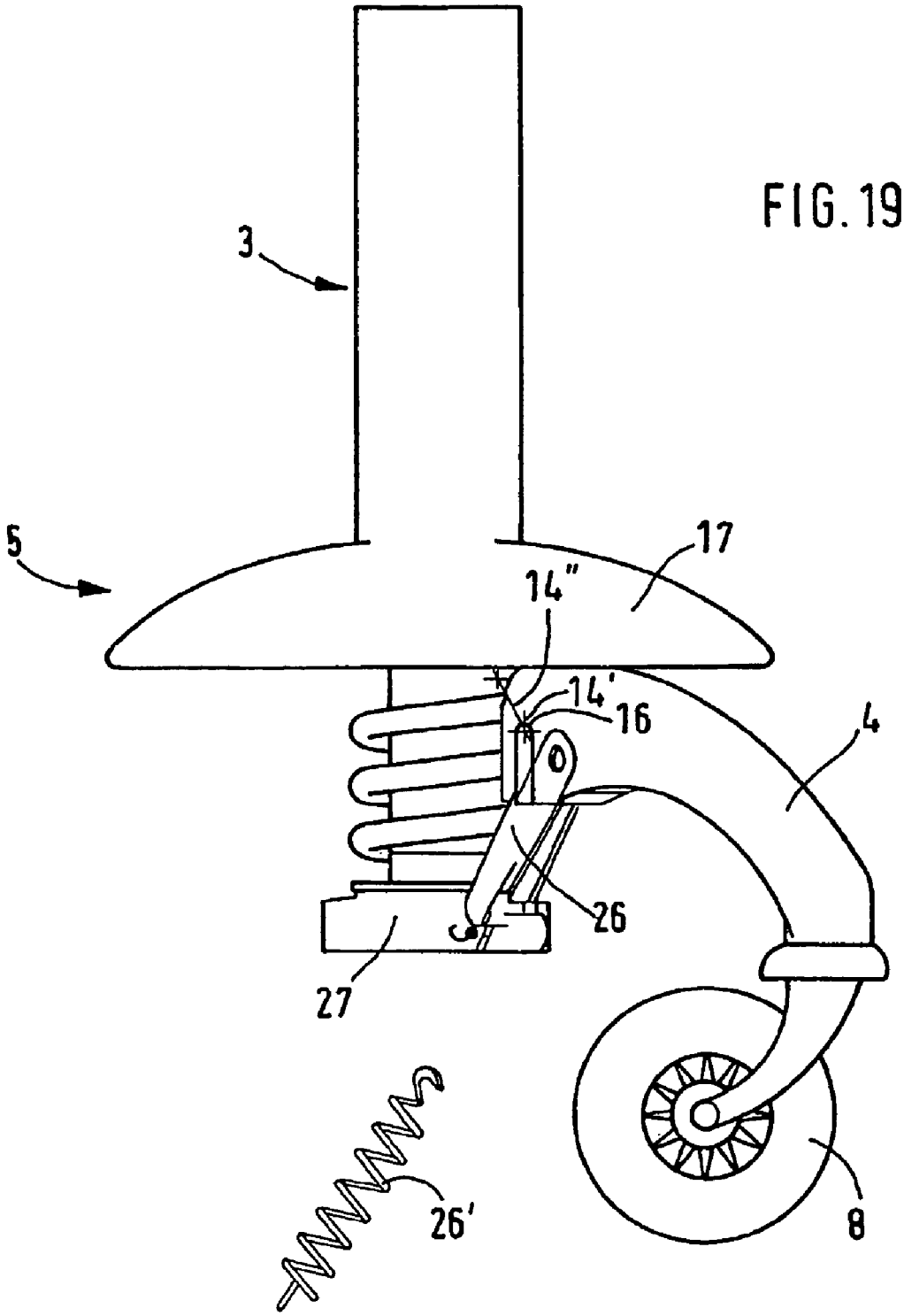
Figure 21:
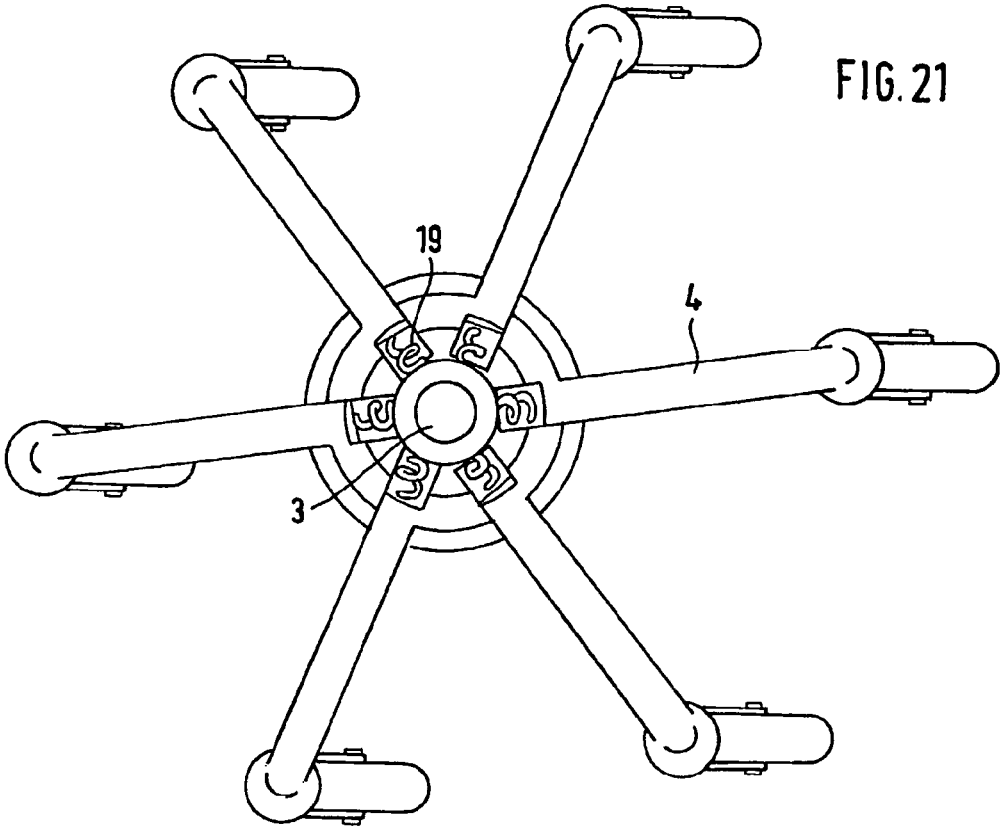
Figure 22:
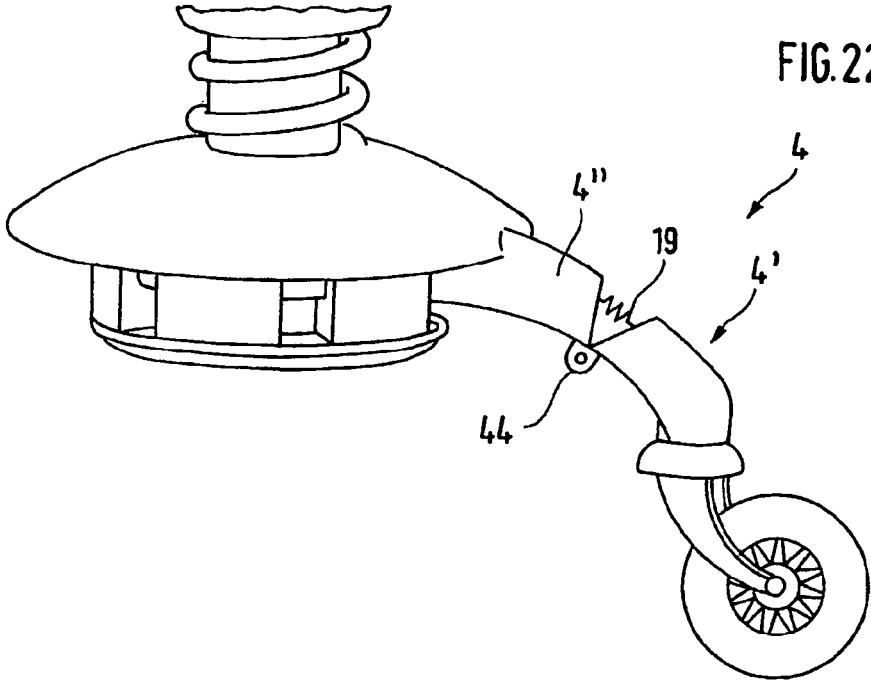
Figure 23:
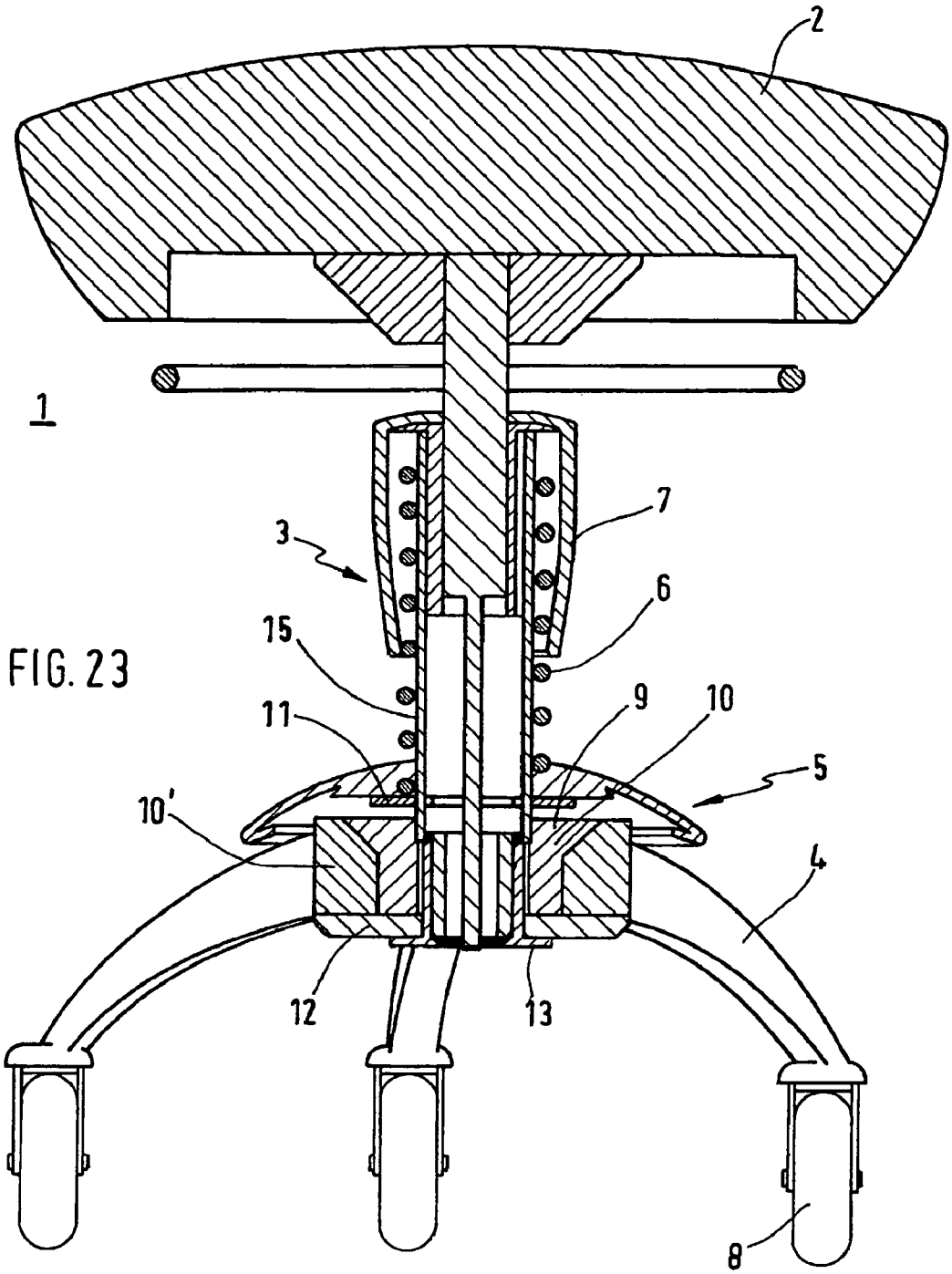
Figure 24:
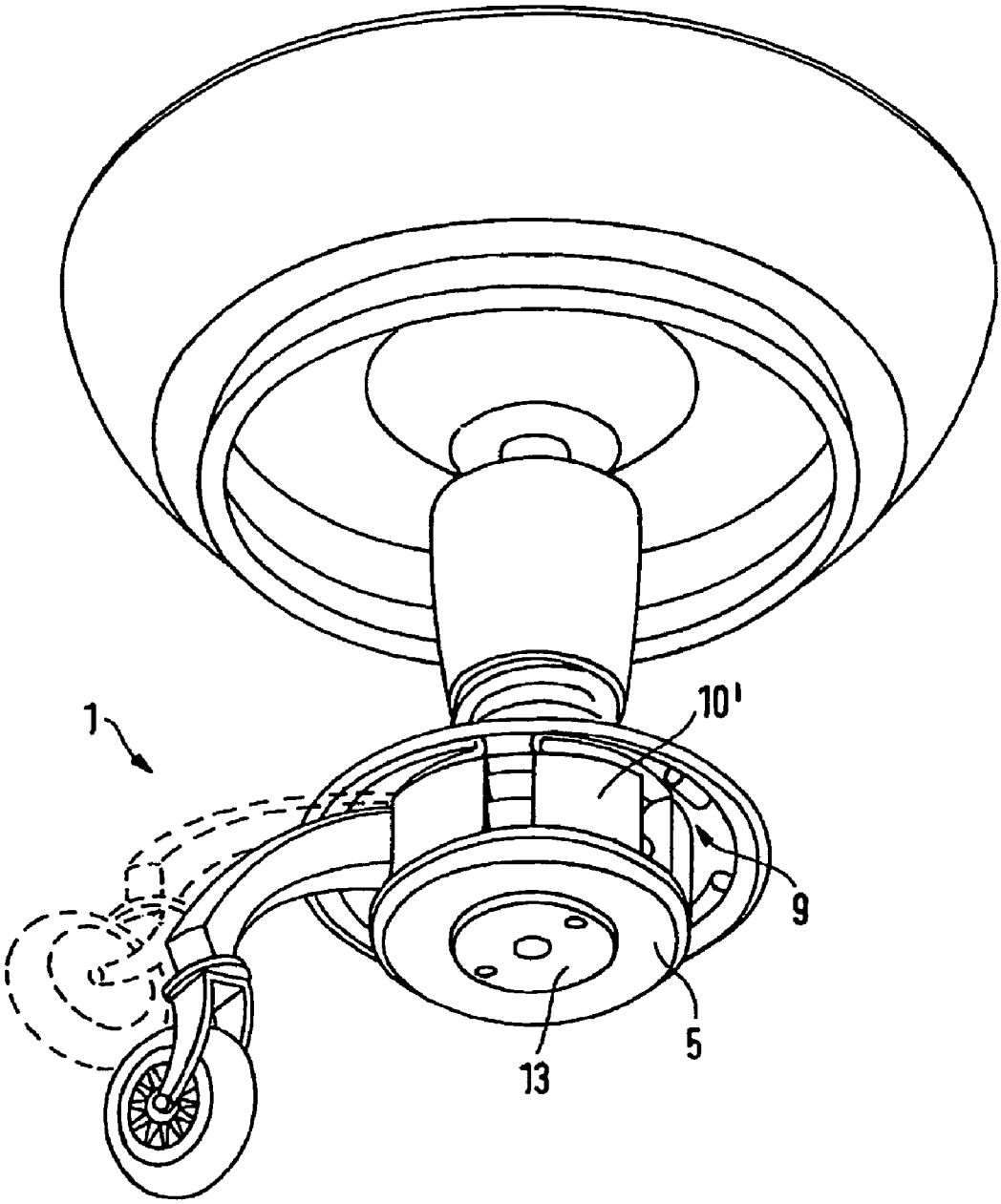
Figure 25:
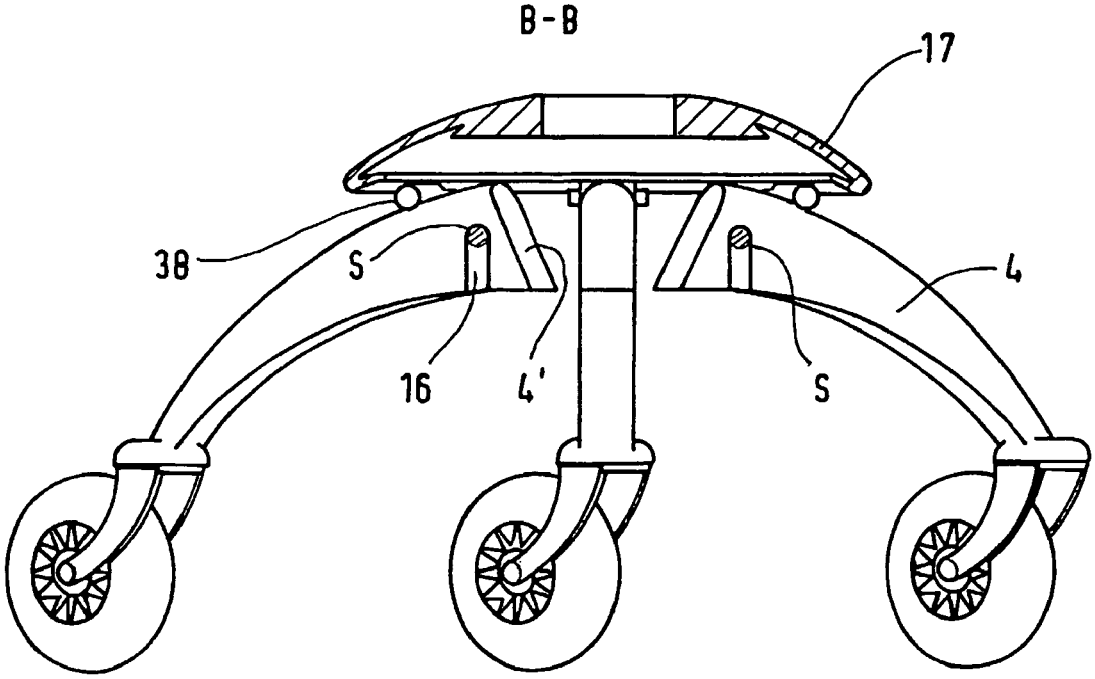
Figure 39:
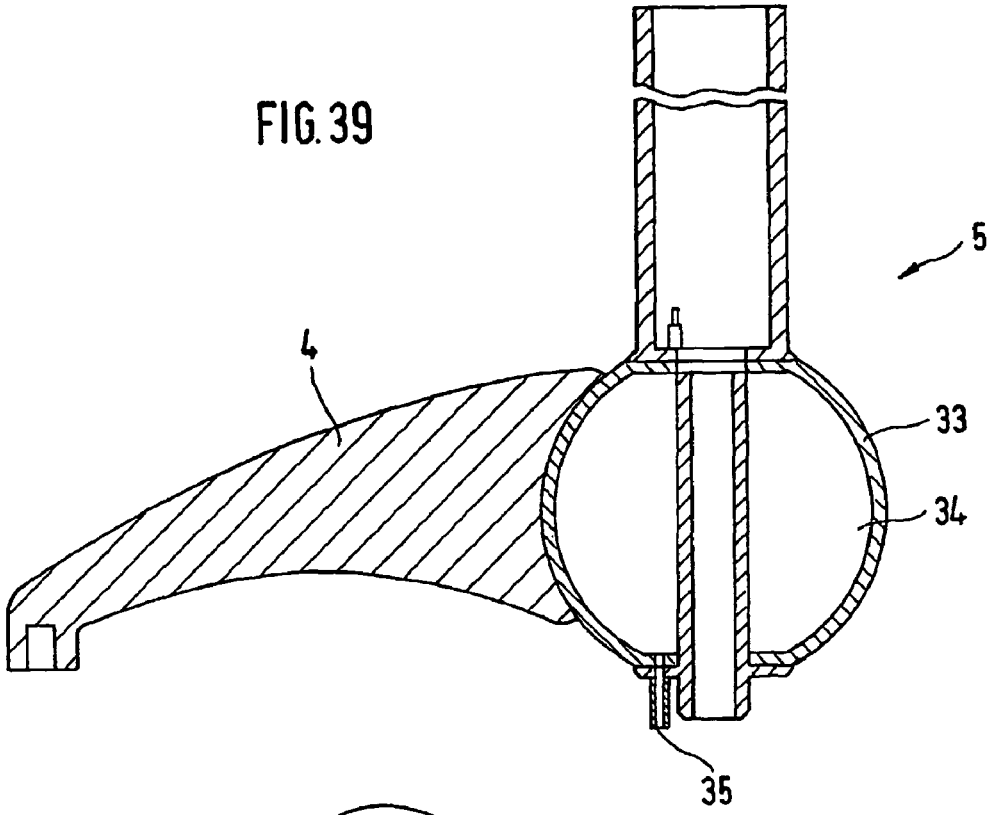
Figure 40:
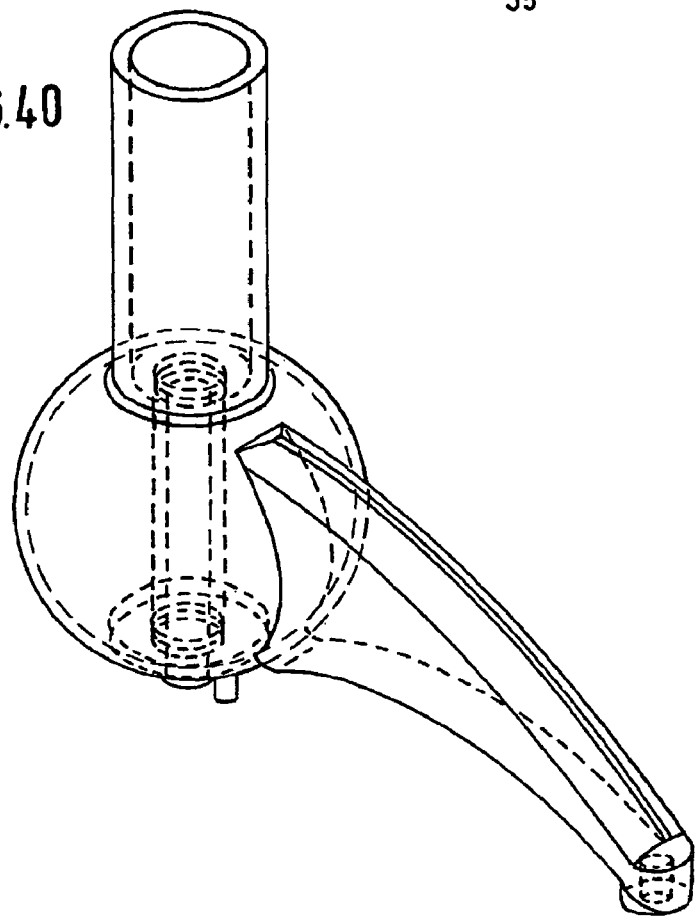

Further details and advantages of the invention are described in the following on the basis of examples of embodiments and with reference to the drawing. They show:

FIG. 1A-1C diagrammatic sectional views through a part of a conventional office chair;

FIG. 2A-2B diagrammatic sectional views through a variant of an office chair;

FIG. 3 a diagrammatic sectional view through the foot of a chair in an extreme position;

FIG. 4A-4B diagrammatic side views of a part of a first office stool according to the invention;

FIG. 4C-4D diagrammatic top views of the first office chair according to the invention given a centered load;

FIG. 5A-5B diagrammatic side views of a part of a second office chair according to the invention;

FIG. 6A-6B diagrammatic side views of a part of a third office chair according to the invention;

FIG. 7A-7B diagrammatic side views of a part of a fourth office chair according to the invention;

FIG. 8A-8B diagrammatic side views of a part of a fifth office chair according to the invention;

FIG. 9 a perspective view of a sixth office chair according to the invention;

FIG. 10A-10B diagrammatic side and sectional views of a part of a seventh office chair according to the invention;

FIG. 11A a perspective view of a part of an eighth office chair according to the invention;

FIG. 11B-11E diagrammatic side, top, and sectional views of the eighth office chair according to the invention;

FIG. 12A-12B diagrammatic side and sectional views of a ninth office chair according to the invention;

FIG. 13 diagrammatic side view of a tenth office chair according to the invention;

FIG. 14 a diagrammatic sectional view of an eleventh office chair according to the invention;

FIG. 15 a diagrammatic side view of a part of a twelfth office chair according to the invention;

FIG. 16 a perspective view from above at an angle onto a foot part of another embodiment according to the invention;

FIG. 17 a diagrammatic representation of a further embodiment of an office chair according to the invention;

FIG. 18 a diagrammatic representation of a further embodiment of an office chair according to the invention;

FIG. 19 a diagrammatic representation of a further embodiment of an office chair according to the invention;

FIG. 20 a representation of an alternative detail of the embodiment of FIG. 19;

FIG. 21 a diagrammatic representation of a further embodiment of an office chair according to the invention;

FIG. 22 a diagrammatic representation of a further embodiment of an office chair according to the invention;

FIG. 23 a diagrammatic representation of an axial section through a rocker stool according to the invention;

FIG. 24 a perspective view of a representation from above at an angle onto the foot part of the rocker stool;

FIG. 25 an alternative embodiment of the foot part with a first embodiment variant of the spring arrangement, FIG. 26 a further embodiment of the foot part with an embodiment variant of the spring arrangement in which the foot elements bear against elastomer material, FIG. 27 a perspective view from below of the holding arrangement with elastomer spring, FIG. 28 a view of an axial section through the tubular leg and the holding arrangement, FIG. 29 a perspective view from above onto a foot part with a further embodiment of the return spring, FIG. 30 a sectional view of a detail of the embodiment of FIG. 7, FIG. 31 a view of the section A-A in FIG. 8, FIG. 32 a diagrammatic representation of a further embodiment of the spring arrangement, FIG. 33 a diagrammatic representation of a further embodiment of an office chair according to the invention, FIG. 33*a* a diagrammatic representation of a further embodiment of the spring arrangement, FIG. 34 a diagrammatic representation of a further embodiment of the spring arrangement, FIG. 35 a representation of an alternative detail of the embodiment of FIG. 11, FIG. 36 a diagrammatic representation of a further embodiment of the foot part and spring arrangement, FIG. 37 a diagrammatic representation of a further embodiment of the spring arrangement, FIGS. 38*a* and 38*b* a diagrammatic representation of a further embodiment of the spring arrangement, FIG. 39 a diagrammatic representation of a further embodiment of the spring arrangement, FIG. 40 a diagrammatic representation of a further embodiment of the spring arrangement, FIG. 41 a perspective view of the embodiment of FIG. 16

Figure 42:
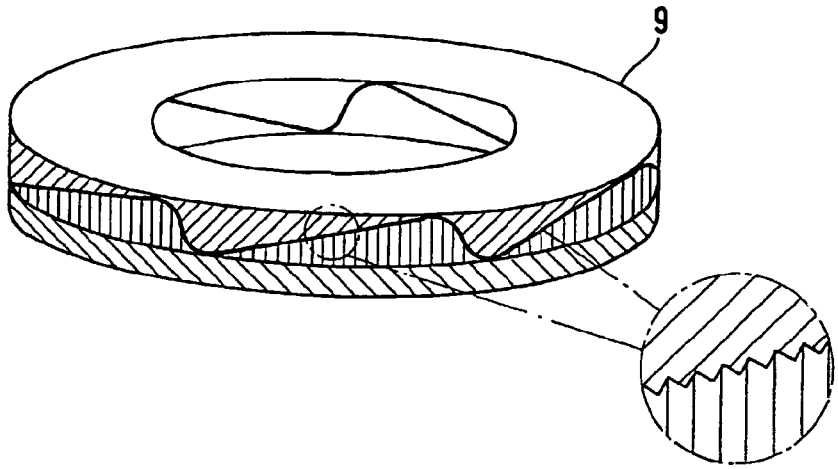
Figure 46:
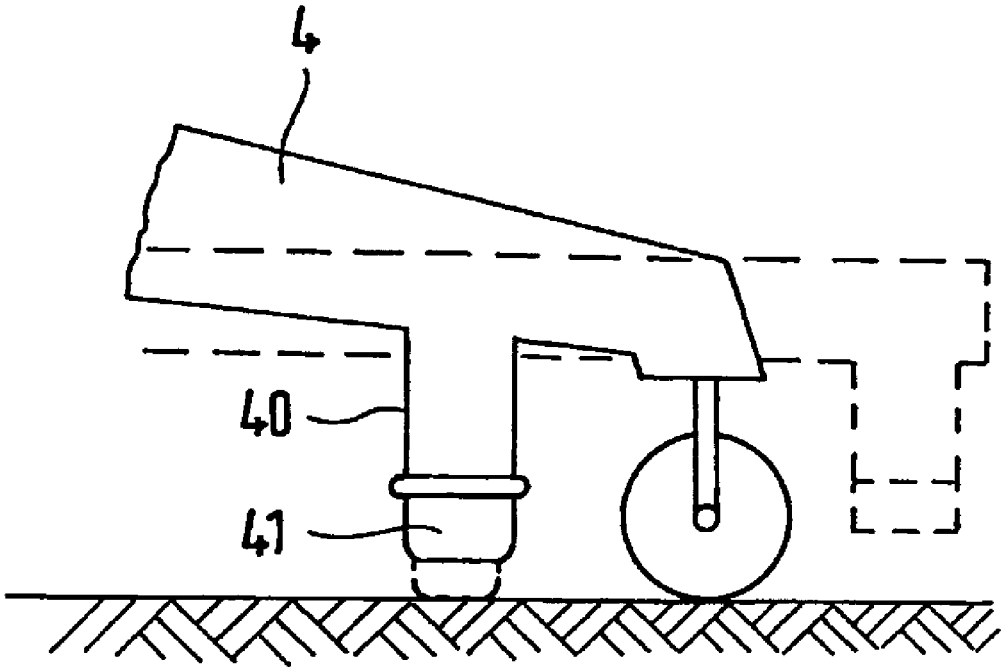
Figure 48:
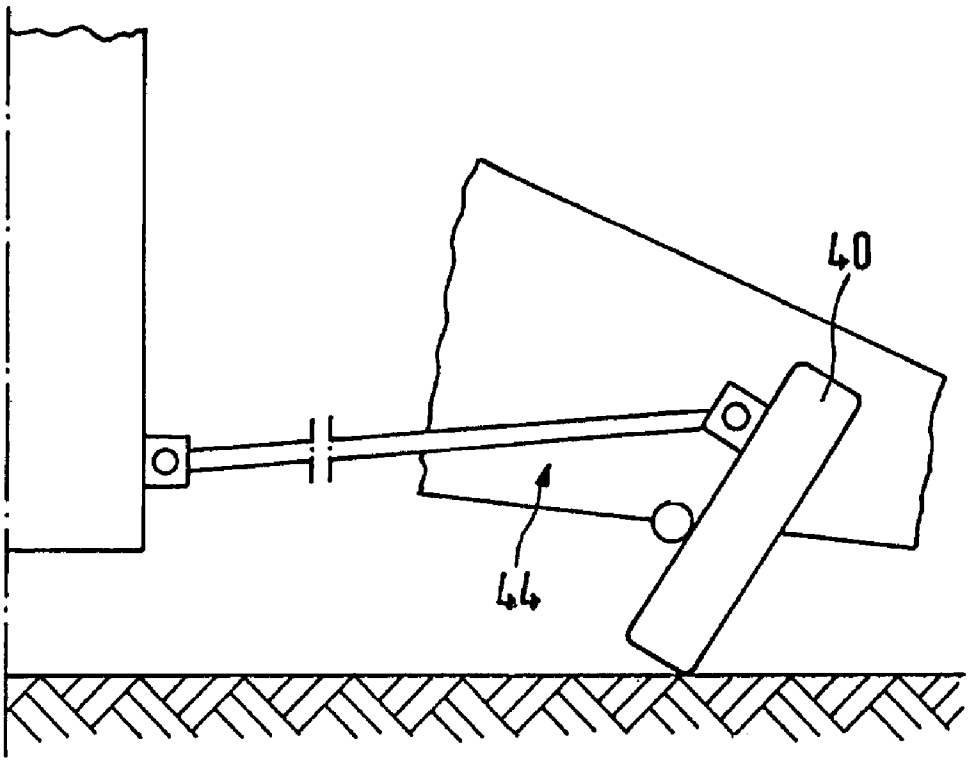
Figure 47:
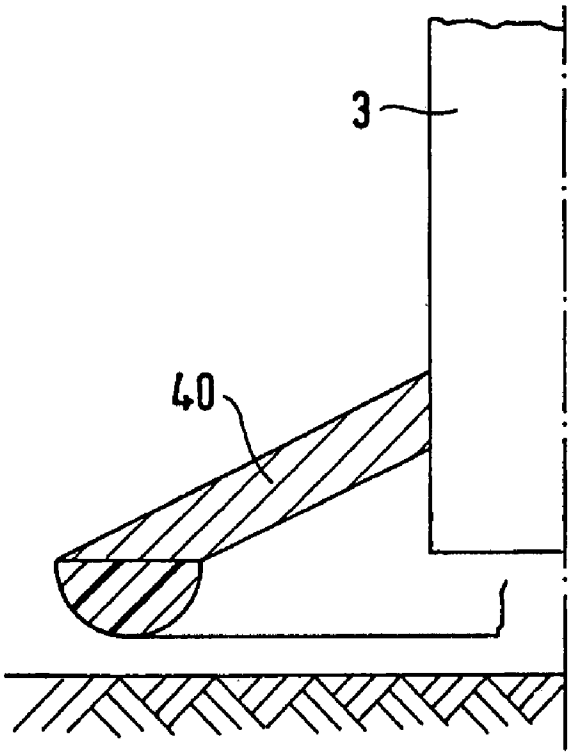
Figure 49:
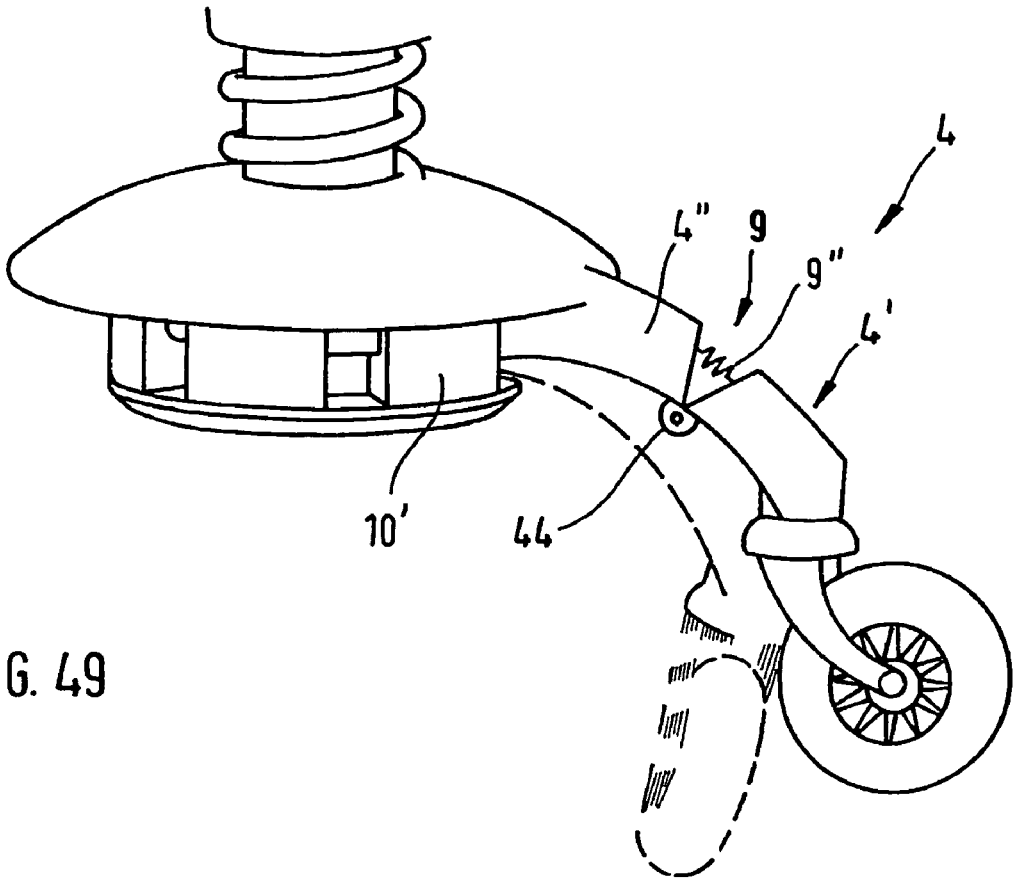

FIG. 42 a diagrammatic sectional representation of a further embodiment of the spring arrangement, FIG. 43 a perspective view of the embodiment of FIG. 17, FIG. 44 a diagrammatic sectional representation of a further embodiment of the spring arrangement with spring disk, FIG. 45 a perspective view of a spring disk of FIG. 19, FIG. 46 a diagrammatic representation of a further embodiment of the spring arrangement with stopper, FIG. 47 a diagrammatic representation of a further embodiment of the spring arrangement with stopper, FIG. 48 a diagrammatic representation of the embodiment of FIG. 22 with the stopper in the operative position, FIG. 49 a diagrammatic representation of a further embodiment of the spring arrangement with stopper,

DETAILED DESCRIPTION

In the Figures, the same reference numerals are used to denote the same components, unless otherwise expressly stated.

Hereinafter advantageous embodiments of the invention are described, wherein said embodiments are cited as examples. They include both different embodiments of the overall invention, as well as assemblies and component parts of the invention. As a rule, the described assemblies and component parts of the different embodiments can be combined, or the assemblies and component parts of individual embodiments can be replaced by assemblies and component parts of other embodiments, respectively. The combinations created thereby can imply smaller adaptations familiar to every person skilled in the art and consequently not described in further detail, for example, to allow for a combined action or engaging of the assemblies and component parts.

Hereinafter so-called resilient elastic foot elements are frequently referred to. In this case, these are according to the invention the resilient, elastically supported foot elements with a return element and/or foot elements which are resilient and readjusting in action due to their own elasticity. The elasticity of the foot elements can be achieved by selecting suitable materials, the combination of different materials and/or through the design.

Hereinafter so-called supporting elements are frequently referred to. In this case, these are in the present context elements which are fixable to a foot part of a chair and which can be pushed or moved simply along a floor surface. As supporting elements, glider feet, or other gliding elements, and rollers are suitable. Elements are used primarily as gliding elements whose sliding surface is adapted to the character of the floor surface. If the chair is to be used, for example, on a carpet, the sliding surface is to be equipped with a corresponding layer which allows for gliding on the carpet. A Teflon or Nylon coating is particularly suited. On a smooth floor surface (parquet flooring, stone flooring, or similar surfaces), a different sliding surface is preferably used, for example, plastic or felt.

Hereinafter instead of supporting elements in several places reference is specifically made to rollers. In this context, the term roller is to be understood as a wheel or a roller that is capable of turning around an wheel axle. Rollers which are rounded are particularly advantageous. Twin rollers are also termed rollers.

Before different embodiments of the invention are described, the different coordinated movements are first addressed that can arise with conventional chairs. This lays the foundation for the understanding of the complex dynamic interrelationships which are purposely employed for part of the chairs according to the invention, wherein according to the invention—as will be described—different effects and movements are superimposed in a complex manner and only occur at all given corresponding dimensioning, or configuring, respectively. The different effects and movements interact positively, as will be explained in context with the different embodiments.

In FIGS. 1A to 1C, the behavior of a conventional office chair is depicted. It shows the details of a foot element 4 of a star-shaped foot cross (foot part). At the free end of foot element 4, a wheel mounting 6 is arranged that supports a roller 8. The wheel mounting 6 in the simple example shown comprises a fork 6.1 with a seat 6.3 (for example, a drill hole) for a pin 6.2. The pin 6.2 is seated in turn in a seat 6.4, provided for in the foot element 4. Typically, a sleeve is inserted into the seat 6.4. This sleeve, however, is not shown in the Figures for the sake of simplicity. The pin 6.2 defines a guiding axle 6.5 which extends vertically to a floor surface 9 in the example shown. Between the guiding axle 6.5 and the wheel axle 8.1 there is a slight misalignment that here is termed an excentric arrangement.

If the chair is now pulled in a positive horizontal direction X, roller 8 runs after the foot element 4, as shown in FIG. 1A. The roller turns clockwise, as shown by arrow 8.2. If the chair is moved in the opposite direction, that is to say parallel to the negative horizontal X axis, this briefly produces the state shown in FIG. 1B in which roller 8 runs ahead of foot element 4. The roller turns counterclockwise, as indicated by arrow 8.2. This state, however, is instable. Roller 8 has the tendency to reverse immediately as soon as a slight "disruptive" force acts on the roller from the side. In this case, the roller shoots out of the pushed state (FIG. 1B) into a position implied in FIG. 1C. This effect is observable in conventional office chairs. In principle, this behavior is similar to that of a truck in which a trailer is pushed backward by a towcar.

Another conceivable variant of a chair is shown in FIGS. 2A and 2B. The variant of the chair shown differs essentially from the chair in FIGS. 1A to 1C in that the guiding axle 6.5 is angled. When the chair is dragged in a positive direction X, roller 8 runs after foot element 4, as shown in FIG. 2A. The roller turns clockwise, as indicated by arrow 8.2. This position is relatively stable, since the virtual starting point Al lies closer to the floor surface 9 than in the arrangement in FIGS. 1A to 1C. In the event the chair is now moved in the opposite direction, that is to say parallel to the negative X axis, the state shown in FIG. 2B is produced in which roller 8 runs after foot element 4. To reach this state, however, a resistance to gravity must be overcome since in the transition to this state the distance A between foot element 4 and the floor surface 9 must increase. To move from the position shown in FIG. 2A to the position shown in FIG. 2B, roller 8 must complete a 180 degree rotation around the guiding axle. In the process, the virtual starting point Al moves upward. This effect is shown and exaggerated in FIG. 1B. If the inclination of the guiding axle 6.5 is small in relation to the vertical position, a slight disturbance (for example, any unevenness of the floor surface 9 or asymmetrical loading) suffices to trigger a rapid return to the position shown in FIG. 2A. An increase in the inclination of the guiding axle 6.5 in relation to the vertical position leads to a continuous worsening of the all-round swivelability (rotation around the guiding axle 6.5) of the roller 8 since the resistance to gravity must be overcome. Depending on the type of rollers and in dependence on the inclination as well as the misalignment between the guiding axle 6.5 and the wheel axle 8.1, there are two eccentric effects that can be more or less pronounced. The first eccentric effect is revealed, as described, as an increase of the distance A. The second eccentric effect occurs since the rollers "tip" over their edge during a rapid return. This second eccentric effect occurs more distinctly, the more canted the roller edges are. In twin rollers, this effect is less pronounced.

As shown in the diagram in FIG. 3, in the extreme case depicted (the guiding axle 6.5 runs parallel to the ground 9 and bisects the wheel axle 8.1), roller 8 cannot shoot around. The flatter the guiding axle 6.5 is the closer one gets to this extreme case.

Another extreme case is one in which the guiding axle 6.5 is arranged perpendicular to and above the wheel axle 8.1 and bisects both axes. The change in direction is only consistently possible since the rollers do not readjust to the rotating direction. This case is not shown in the diagram.

The chairs described thus far in conjunction with FIGS. 1A to 1C and 2A, 2B show arrangements of rollers in which the inclination of the guiding axles is rigid in relation to the floor surface.

To make a chair available that reacts to a given situation, in accordance the invention the foot part of the chair is designed in such a way that it reacts resiliently to loads. This effect can be achieved either by resiliently spring mounting the foot elements or in that the foot elements themselves have an elastic effect. A combination of both effects is also possible.

In other words, it is important that a foot part in accordance with the invention be designed flexibly and/or spring-mounted at least in part. For this purpose a chair of this kind may have flexibly supported foot elements (chair legs), spring-mounted foot elements (chair legs) or a combination of said foot elements.

Supporting elements are provided for on the foot part which may shift vis-à-vis the floor surface when the foot elements move and/or are deformed. For this purpose a chair of this kind may have gliders or rollers on flexibly supported foot elements (chair legs), on spring-mounted foot elements (chair legs) or a combination of said foot elements.

Hereinafter embodiments of the invention are primarily described in which rollers serve as supporting elements, wherein this focus on roller-based embodiments should not be construed restrictively.

To make a chair available that reacts to a given situation, in preferred embodiments of the invention the position (inclination) of the guiding axle of the rollers is designed to be variable. The change of the position (inclination) of the guiding axles of the rollers is achieved by the resilient, spring-mounting of the foot elements (chair legs), and through the elasticity of the legs themselves, or through the flexible, elastic mounting of the pins of the rollers in the foot element. The chair is designed in such a way that it takes or strives for the following states:

(1) in an unloaded state, the guiding axles of the individual chair rollers are at a steep angle, preferably almost perpendicular to the floor surface or slightly negatively inclined in order to create an initial blocking;

(2) in a loaded state, the guiding axles of the individual chair rollers are flat (in the sense of positively inclined), that is to say the angle of inclination is greater than in an unloaded state.

Through this situation-dependent inclination of the guiding axles, the degree of freedom of the roller system is reduced, consequently making a coordinated running of all rollers of this kind of a chair according to the invention impossible. When the chair is loaded, elimination of the otherwise coordinated running direction takes place and there is a braking action produced by the interaction of at least two different rollers. This braking action is produced without requiring a braking medium that slows the rollers individually. Through this braking action the chair as a whole is stopped and can no longer be pushed in relation to the floor surface.

The individual rollers 8 of the chair 1 are, however, still movable—literally, unrestricted—and can roll radially to a central axis 11 of the chair 1 in order to provide for a (resilient) up and down movement of the chair 1, as indicated in the diagrams of FIGS. 4A to 4D. A dynamic sitting behavior is thus still possible according to the invention, even though the braking action occurs as described.

In the event gliding elements are used as supporting elements, these can also be aligned radially to a central axis of the chair.

In accordance with the invention, the guiding axle and the wheel axle of a roller support are related in such a way that the roller changes from a so-called instable position when the chair is loaded into a so-called stable position. This transition is herein referred to as a dipping movement. This dipping movement is clearly noticeable on the chair, depending on the embodiment, and includes a rolling and swiveling movement of the rollers (double eccentric action). A roller makes a small rolling movement around the wheel axle during the dipping movement and the roller turns by about 180 degrees around the guiding axles. When swiveling around the guiding axle, the roller tips over one of its edges that defines the transition of the running surface into the side wall of the roller. These effects have already been described in conjunction with FIG. 2B.

The stated effects that occur if the rollers rapidly return from a position into another, more stable position are influenced by different parameters which largely either support or abate the effects. One example is the shape of the rollers. If cylinder-shaped rollers or twin rollers are used whose cylinder axis corresponds to the wheel axle, depending on the dimensioning, a reversal of the rollers is more difficult. Thinner rollers or spherical rollers, in contrast, are easier to swivel about the guiding axles since their running surface has a lower expansion parallel to the wheel axle. Another parameter is excentricity (at the beginning referred to as misalignment), that is to say the distance of the guiding axle 6.5 in relation to the wheel axle 8.1. Another option of influencing the stated effects is produced by the seating of the rollers. Easy running rollers follow the movements of the chair faster and the chair may be endowed with agility in its behavior. Through a slight braking seating of the rollers, the behavior can be damped. The chair is less aggressive in its behavior.

The same applies to gliding elements with good gliding quality that they follow the movement of the chair faster and easier. Gliding elements that do not slide as well result in a chair that is less aggressive in its behavior.

This produces—depending on the arrangement and depending on the selection of the individual parameters of the support elements and their arrangement/seating (such as for example excentricity, roller size, friction resistance, geometry and character of the surfaces and of the floor surface, etc.)—a deforming effect of the described movement behavior.

It is considered another essential element of the invention that the point of support of the chair's support elements shifts radially outward from a central chair axis under loading and thereby increases the radius of the supporting surface. This automatically leads to an increase in the chair's stability.

A return force which is produced in different ways counteracts this outward shifting. In rigid foot elements 4 (legs) attached flexibly to a central column 3 of the chair 1, a return force can be produced by mounting spring elements. Tension springs, leaf springs, torsion springs or compression springs are used in order to produce the return force. It is conceivable, however, that the foot elements 4 be flexibly mounted. A flexible seating results in a return force when the chair 1 is loaded that acts on the respective foot element 4.

The return force may, however, also be produced in such a way that the foot elements 4 themselves or sub-sections of them are resilient in design. In this way, a foot element may demonstrate an elastic effect on the basis of its shape and/or the materials used. Typically, the foot elements 4, or sub-section thereof, deform if the chair 1 is loaded. A force (return force) arises with increasing deformation that counteracts the deformation.

The return force can also be produced by an interaction of several of the stated effects.

Details of a first embodiment are described in connection with FIGS. 4A to 4D. In FIG. 4C, a diagrammatic top view of the chair 1 is shown that simply has four rollers 8 arranged in a star shape in relation to a vertical axis 11 of the chair 1. The chair 1 is shown in an unloaded state in FIG. 4C. The chair 1 by virtue of the points of support of rollers 8 on the floor surface 9 defines a support surface that is indicated by a circle with a diameter A1.

FIGS. 4A and 4B show a sectional rendering that cuts through two of the four rollers 8 located in the plane of projection. Both rollers 8 have each one fork 6.1 with a pin 6.2. The pin 6.2 defines the guiding axle 6.5. The guiding axles 6.5 of all rollers 8 bisect the vertical axis 11 when the load is centered. The guiding axles 6.5 are rather steeply angled in the state shown in FIGS. 4A and 4C. The angle of inclination β typically amounts to between 0 and 30 degrees in this state and preferably between 0 and 10 degrees. Depending on the embodiment, it is conceivable, however, that the guiding axle 6.5 has a negative angle β in an unloaded state. Under vertical pressure in the direction of the axle 11 from the top down, the negative angle β changes due to the resiliently acting foot elements via a neutral position to a positive angle β. Through the elastic effects of the legs the guiding axles 6.5 distance themselves from the vertical axle 11 with the increasing vertical pressure on the floor surface 9. The negative angle β can lie between −5 and 0 degrees. If the angle β is set negatively in an unloaded state, this produces a braking action (termed initial blocking) of the chair 1. Moreover, due to the negative inclination of the rollers 8, the support surface is reduced since all rollers 8 are oriented inward in a star shape. If the excentricity, that is to say the misalignment between guiding axle 6.5 and the swiveling axis 8.1 increases, the angle β of the roller 8 also increases.

If a load is applied centrally to chair 1, as indicated by arrow 10 in FIG. 4B, the rollers move radially outward, as can be seen in FIG. 4D on the basis of the enlarged circle. This type of a lowering movement of the chair 1 combined with an expanding movement of the foot part of the chair 1 is possible without problem since the four rollers 8 can run outward on radially oriented paths independent of each other. In this way, an enlargement of the support surface takes place (A2 is greater than A1), which consequently raises the stability of the chair 1. The enlargement of the support area is an important characteristic of the chairs according to the invention. It is to be noted that given an asymmetrical loading of the chair 1, an oval or another shaped support surface A2 is produced.

Through the described expanding movement, load impacts may be taken up by a rolling apart of the rollers 8, and an up and down movement is possible. This type of an expanding movement also occurs when gliding elements are used.

A prerequisite for the inclination of the guiding axle(s) of the rollers are resilient, elastically seated legs with return force or spring-mounted legs.

The following approaches according to the invention exist to achieve a situation-dependent inclination of the guiding axle(s) of the rollers:

(1) The suspension means of the rollers 8 on the foot elements 4 is provided for such that the guiding axles 6.5 of every single roller 8 can tilt in relation to the foot element 4 depending on the load (see FIGS. 5A and 5B);

(2) The suspension means of rollers 8 on the foot elements 4 is rigid, but the foot elements 4 are flexibly mounted on chair 1 and indeed in such a way that the inclination of the guiding axles 6.5 in relation to the floor surface 9 changes due to a movement of a foot element 4 (see FIGS. 6A and 6B);

(3) The suspension means of rollers 8 on the foot elements is rigid, but the foot elements 4 are flexible and indeed in such a way that the inclination of the guiding axles 6.5 changes in relation to the floor surface 9 due to a deformation of the foot element 4 (see FIGS. 7A and 7B);

(4) A combination of one or several of the aforementioned approaches.

Details of a second embodiment are described in connection with FIGS. 5A and 5B. They show a diagrammatic side view of the chair 1. The chair 1 is essentially constructed with mirror symmetry. For the sake of simplicity, only one part of the chair 1 is shown. The chair 1 comprises a seat (not shown) and a central column 3 that is rigidly joined to the foot elements 4. It may, for example, be a rigid foot cross with three, four, or five foot elements 4. However, a disk, ring, or pot-shaped foot element may also be used in the middle of which column 3 is attached. Column 3 may have a cone on its lower end that is seated, for example, in a center hold of such a foot cross or foot element. The roller 8 is supported by a suspension means that includes a fork 6.1. On the upper end of fork 6.1 there is a tiltable pin 6.2 that is seated in the foot element 4. If the chair is loaded, it is lowered and the rollers 8 make a dipping movement, as shown in FIG. 5B in which the guiding axle 6.5 inclines by an angle of inclination β. Depending on the load, the guiding axles 6.5 incline at different distances when chair 1 moves downward. The support surface increases. Through the inclining of the guiding axles 6.5, a resilient, elastic behavior of the foot part of the chair 1 is produced.

Details of a third embodiment are described in connection with FIGS. 6A and 6B. They show a diagrammatic side view of the chair 1. The chair 1 is essentially constructed with mirror symmetry. For the sake of simplicity, only one part of the chair 1 is shown. The chair 1 comprises a seat 2 and a central column 3. The seat height may like conventional chairs, for example, be changed by using a lifting spindle 13 seated in a screw thread of the column 3. The suspension means of the rollers 8 on the foot elements 4 is rigid. The foot elements 4, however, are attached flexibly to chair 1 and indeed in such a way that the inclination of the guiding axle 6.5 in relation to the floor surface 9 changes due to a movement of a foot element 4. In the embodiment shown, foot element 4 is pivotable on its upper end via a horizontal axis 3.4 in its connection to the column 3. This linking to the column 3 is diagrammatically rendered. In an unloaded state (FIG. 6A), the guiding axle 6.5 of the roller 8 is slightly angled. The angle of inclination β lies preferably in a non-operative state between −5 and 10 degrees. If chair 1 is centrally loaded, as shown in FIG. 6B, the rollers 8 move radially outward. The foot element 4 is deflected, wherein the angle of inclination β becomes larger. In this way, the guiding axles 6.5 of the rollers also incline, as can be seen in FIG. 6B. The angle of inclination β can take an inclination of up to 60 degrees.

For this expanding movement of the foot element 4 to take place under control, a return element is preferably used or an arrangement is selected that counteracts the expanding movement with a return moment. A greatly simplified return element 12 is indicated in FIG. 6B. It applies a return force R to the foot element 4 that is oriented radially to the axis 11. By means of the return element 12, the characteristic of the swiveling movement can be influenced and it can be prevented that the foot elements 4 are completely expanded and the lower end of column 3 of the chair 1 touches the floor surface 9. The movement behavior of the foot elements 4 that is predetermined by the type of suspension means and the presence of return elements is termed resilient.

The foot part of the chair 1 in accordance with FIG. 6A, 6B has at least three foot elements 4 and a central column 3, wherein each of the foot elements 4 is mechanically mounted in such a way in relation to the column 3 that the foot elements 4 carry out a swiveling movement, as described in connection with FIGS. 6A and 6B, and move radially apart. A return force R is preferably applied to the foot elements 4.

In this embodiment, a rigid mounting of the rollers 8 on the foot elements 4 in which they can turn around the guiding axle 6.5 is preferred, however, in which their inclination in relation to the foot elements 4 does not change. The type of an embodiment shown in FIG. 6A, 6B can be modified by also seating the guiding axle 6.5 so that it may incline, which results in a superposition of two different tilting movements when chair 1 is loaded. In this way, the resilient action also changes.

Details of a fourth embodiment are described in connection with FIGS. 7A and 7B. A diagrammatic side view of the chair 1 is shown. The chair 1 essentially constructed with mirror symmetry. For the sake of simplicity, only one part of the chair 1 is shown. The chair 1 comprises a seat (not shown) and a central column 3. Foot elements 4 are provided that are rigidly connected to the column 3. The suspension means of the rollers 8 on the foot elements 4 is rigid. If chair 1 is centrally loaded, as shown in FIG. 7B, the rollers 8 move radially outward since the foot elements 4 are subject to deformation. Depending on the rigidity of the foot elements 4, this deformation may be more or less distinct. Instead of providing several individual foot elements 4, a disk, ring or pot-shaped foot element may also be used, wherein this element 4 is elastic in design. The resilient action is produced in this embodiment essentially by the elastic deformation of the foot elements 4.

In FIG. 7A, the angle of inclination β amounted to about 0 degrees. Under loads, the angle of inclination β increased, as indicated in FIG. 7B. With elastically deformable foot elements 4, changes of the angle of inclination β between −5 and 30 degrees can be produced. The angle of inclination lies preferably between −5 and 10 degrees.

In FIGS. 8A and 8B, another embodiment is shown. They show a diagrammatic side view of the chair 1. The chair 1 is essentially constructed with mirror symmetry. For the sake of simplicity, only one part of the chair 1 is shown. The chair 1 comprises a seat (not shown) and a central column 3. A disk-shaped elastic foot element 4 is provided for that is rigidly connected with the column 3. In the example shown, the column 3 at its lower end that is preferably cone-shaped in design is seated in foot element 4, as indicated in the diagram by a dotted line. The suspension means of the rollers 8 on the foot element 4 is rigid. If chair 1 is centrally loaded, the rollers 8 move radially outward since the foot element 4 is subject to deformation. Depending on the rigidity of the foot element 4, this deformation may be more or less distinct. The foot element 4 may also be ring- or pot-shaped in design.

If the chair is asymmetrically loaded, the foot element 4 is deformed and the guiding axle 6.5 of the roller 8 inclines in relation to the floor surface 9, as shown in sections in FIG. 8B. The angle of inclination β is between 0 and 30 degrees for a loaded stool. The angle of inclination lies preferably between 0 and 10 degrees. The resilient action is produced in this embodiment essentially by the elastic deformability of the foot element 4.

A further embodiment is shown in FIG. 9. It shows a chair 1 that has a foot part that comprises a vertical column 3 and a foot element with six legs 4. A roller 8 is attached to each of the six legs, wherein each of the rollers 8 is mounted and can be rolled around a wheel axle 8.1 and is connected and freely rotable by means of a guiding axle 6.5 to the respective leg 4. The suspension means of the rollers 8 is rigidly connected with the legs 4, that is to say the rollers 8 can turn together with their suspension means around the guiding axle 6.5, but the inclination of the guiding axle 6.5 cannot be changed in relation to the legs 4. The embodiment shown stands out in that the legs 4 are mechanically mounted in relation to the column 3 in such a way that they make a swiveling movement when the chair is loaded and move radially apart. The seating includes an elastic ring element 4.1, located on the lower end of the column 3. The legs 4 extend radially through the ring element 4.1. The mechanical suspension means of the legs 4 is protected by the ring element 4.1 and the ring element 4.1 effects a return force on the legs 4. When a load is applied to the chair 1, at least one of the rollers 8 automatically makes a dipping movement in which the guiding axle 6.5 of this one roller 8 changes its inclination β in relation to a floor area. In this way, at least one point of support of the chair 1 shifts outward.

The chair 1 according to FIG. 9 is shown in an unloaded state and the rollers 8 take a position in which the guiding axles 6.5 are essentially perpendicular, or, in the event an initial blocking is desired, slightly negatively inclined. Through the perpendicular or slight negative inclination, the degree of freedom of the rollers 8 is not essentially limited and the rollers 9 follow every movement of the chair 1 without problem.

The resilient action is produced in this embodiment essentially by the special elastic seating of the legs 4.

The legs 4 are preferably made of plastic, ideally out of a fiber-reinforced plastic; or out of diecast aluminum. It may also, however, be manufactured from other materials, such as for example wood. An elastic effect may also be achieved through the combination of suitable materials, or by a suitable design.

In a preferred embodiment, a seat 2 and a back rest 2.2 are provided which are mounted with a holder 2.1 beneath the seat 2.

In addition or alternatively, the legs 4 themselves can be designed to be elastically deformable. The deformability may be achieved, for example, by a side torsion of the axles of the legs 4.

The return force can be set preferably by means of a spring element (for example, a spring) mounted on the column 3 which acts on the legs 4 of the chair 1. This type of a spring 14 is shown in FIG. 9. This spring 14 is optional. By means of this type of a spring, the degrees of freedom of movement can be controlled by influencing an elastic element located in the area of the column 3.

Details of a further embodiment are shown in FIGS. 10A and 10B. FIG. 10A is a side view of the foot part of a chair and FIG. 10B is a sectional view along the line A-A. The chair has a central column 3 which includes a gas strut of a conventional design. The gas strut consists of the elements 3.1, 3.2 and 3.3. By means of the gas strut, a seat of the chair can be adjusted in height. A total of five curved legs 4 are provided. A roller 8 is attached to each of the five legs 4, wherein each of the rollers 8 is seated rollably around a wheel axle 8.1 of a suspension means 6.1 and by means of a guiding axle 6.5 is freely turnable and connected to the respective leg 4. The suspension means 6.1 of the rollers 8 is rigidly connected to the legs 4, that is to say the rollers 8 together with its suspension means 6.1 can turn around the guiding axle 6.5, but the inclination of the guiding axle 6.5 cannot be changed in relation to the legs 4. The embodiment shown stands out in that the legs 4 are mechanically mounted in relation to the column 3 in such a way that they make a swiveling movement when the chair is loaded and move radially apart. The seating includes a ring element 4.1, located on the lower end of the column 3. Each of the legs 4 is seated in a sleeve 4.2, as can be seen in FIG. 10B. Each of the legs 4 is provided with its own swivel pin 4.3. This swivel pins 4.3 are preferably located tangentially to the cylinder-shaped circumference of the column 3 and extend perpendicularly to the central axis 11 of the chair. The ring element 4.1 has an upper ring 4.4 and a lower ring 4.5 in the embodiment shown. An elastic ring element 4.6 is located between these two rings which exerts a return force on the ends of the legs 4, in the event the legs 4 are swiveled around the swivel pins 4.3. The return force is produced by a compression (deformation) of one part of the elastic ring element 4.6. Optionally, the degree of freedom of movement can be controlled by means of a spring or disk by influencing the elastic ring element 4.6. This type of influence may, for example, be realized in such a way that the elastic ring element 4.6 may only deform upward or not at all when subjected to a load by one of the legs 4. The rollers 8 are seated in a suspension means that is fork-shaped in design, as can be seen in FIG. 10B. The seating of the rollers 8 is also here excentric, that is to say the guiding axles 6.5 and the wheel axles 8.1 do not bisect each other. The resilient action is produced in this embodiment essentially by the special seating/suspension means of the legs 4.

A further embodiment of flexibly seated chair legs 4 which can be used advantageously in connection with the present invention is shown in FIGS. 11A-11E in various views. The rollers are not shown in FIGS. 11A-11E. FIG. 11A is a perspective view of the foot part of a chair. The chair has a foot part with five legs 5 and a central column 3. FIG. 11B shows a sectional detail view through a lower section of the chair. In FIG. 11C, a top view onto the foot is shown in which the radial arrangement of the legs 4 can be seen. Each leg 4 is individually connected to a ring-shaped element 4.1 by means of a mechanical suspension means 4.7. FIG. 11D is a sectional view along the line A-A, and FIG. 11E is a sectional view along line C-C. In this sectional view, details of the mechanical mounting 4.7 can be seen. Each of the legs 4 is hinged by means of a tensioning element 4.7, for example, in the form of a steel wire, to the ring-shaped element 4.1. The tensioning element 4.7 is seated in an elastic receptacle that appears in the Figures in dark gray. Depending on the tension of the tensioning element 4.7, the "elasticity" of the suspension means can be set.

Through the ring element 4.1 and the special design of the tensioning elements 4.7, a return force acts on the legs 4. The resilient action is produced in this embodiment essentially by the special seating/suspension means of the legs 4.

The legs are preferably made of plastic, ideally of fiber-reinforced plastic, or diecast aluminum, or of wood.

A sectional view through a further chair 1 according to the invention is shown in FIG. 12A. A diagrammatic side view is found in FIG. 12B. The chair 1 has several legs 4 which are mechanically mounted in relation to a central column 3. A seat 2 is located on the upper end of the column 3. The column 3 includes a spring mechanism whose individual elements are not described any further here. If suffices to say that by adjusting the cap 14.1 the spring 14.2 can be acted upon so that the degrees of freedom of movement are controlled by influencing an elastic ring element 4.11. This type of influence may be realized, for example, such that the elastic ring element 4.11 may only deform upward or not at all when subjected to a load by one of the legs 4. The mechanical mounting of the chair legs is executed as follows. There are elastic elements/segments 4.8 and 4.11 clamped between a lower ring-shaped element 4.10 and an upper ring-shaped element 4.9. The ring-shaped element 4.9 is preferably designed in such a way that it yields when one of the legs 4 moves upward, as is implied in FIG. 12B. The return force that acts on the legs 4 may be adjusted by the pressure of the spring 14.2 that acts upon the elastic ring element 4.11. The legs 4 are swivelably connected with a supporting part of the column 3. During assembly, the legs 4 can simply be put in before inserting the lower ring-shaped element 4.10 and the upper ring-shaped element 4.9. This type of a connection of the legs 4 with the column 3 can, for example, be provided by means of an inserted pin or a similar connection. The elastic elements/segments 4.8 and 4.11 form, as shown in FIG. 12B, seat pockets for the legs 4. If a leg 4 is now pushed upward in relation to the column 3, for example, in the event of a loading of the chair 1 by a user, the chair leg 4 pushes the element/segment 4.11 together, and a return force is produced. In the example shown, the element/segment 4.11 has an angled surface 4.12 which angles away from the central axis 11 of the column 3. Depending on the inclination of this surface 4.12, on the material of the elastic element/segment 4.11, its thickness, and the impact of the spring 14.2, the return force may be influenced. An elastomer ring 4.11 is preferably used which is cylindrical in its lower portion and conical in its upper portion, wherein the conical portion defines the surface 4.12. The resilient action is produced in this embodiment essentially by the special seating/suspension means of the chair legs 4.

Further details of this type of a chair are to be found in the German patent application DE 10338549.1, submitted on Aug. 19, 2003 and entitled "Rocker seat" cited at the beginning.

In FIG. 13, another preferred embodiment is shown. The foot of a chair is shown that has a central column 3. The chair has six legs 4 of which four can be seen in the view. Each of the legs 4 is L-shaped, wherein the L lies flat and the short leg 4.16 of the L runs parallel to the central axis 11 of the column 3. The long leg 4.15 of the L runs essentially parallel to a floor surface 9. On the short leg 4.16 several spaced recesses 4.13 are provided. The legs 4 are arranged in such a way around the column 3 that an elastic ring-shaped element 4.14 can encircle the six legs 4 and rests in the recesses 4.13. In the embodiment shown, the ring-shaped element 4.14 is placed in the second recess seen from above. Above and/or below the legs 4 can be clamped by disks 3.4, 3.5 or similar elements. Depending on the position or number of the ring-shaped elements 4.14, the lever arm and thereby the hardness of the setting is changed. The legs 4 can move radially in planes that are perpendicular to the central axis 11. These planes form an angle of 60 degrees to each other, in the event six legs 4 are to be used. Alternatively, an elastic ring or another elastic body can be positioned from below between the legs 4. By means of this type of an element, an initial expanding of the legs may be regulated. The resilient action is produced in this embodiment essentially by the special seating of the legs 4 and the spring element 4.14.

Alternatively, or additionally, the legs 4 themselves may be elastic in design and bend under loading. In this case, the ring 4.14 may be engineered inelastically and bring about a change of the length of the elastic legs 4 (lever length).

In a further embodiment, the legs 4 are designed such that their length may be changed. The legs 4 may, for example, be telescopic.

A further embodiment is shown in the detailed view of FIG. 14. A central column 3 has a cylinder-shaped projection 3.7 on its lower end that is located concentrically to the central axis 11. Around this cylinder-shaped projection 3.7 is an elastic convex element 3.6, that forms a cavity in the example shown. The legs are connected to the elastic convex element 3.6, as shown on the basis of a single leg 4. On the free end of the leg 4 is a recess 6.4 for seating the pin of a roller suspension means. When the chair is loaded, the element 3.6 deforms and thereby gives the leg 4 the necessary mobility. By moving the leg 4, the angle of inclination of the guiding axle 6.5 changes. The element 3.6 may have a valve 3.8 which permits a change in the pressure in the cavity 3.9 and thereby influencing the spring characteristic of the element 3.6.

Instead of a convex element 3.6, a cylinder-shaped element or an element of another shape may also be used. The resilient action is produced in this embodiment essentially by the special suspension means of the legs 4.

In a preferred embodiment, the chair is designed with rollers that serve as supporting elements in such a way that (1) it is braked when not in use in order to prevent the chair from rolling when the user sits down or when bumped. This is achieved by providing the guiding axle with a slight negative inclination ($-5<\beta<0$ degrees);

(2) it can roll freely when the seated user is centered (symmetrical load);

(3) it reveals a braking action when loaded on one-side (asymmetrical loading).

Common to all embodiments is that a dynamic sitting behavior may be guaranteed by the resilient action of the foot part. In the process, the movement of sitting is achieved in all three dimensions (dynamic sitting behavior) by moving the legs and, as applicable, in combination with the gliders/rollers of the chair's supporting elements.

Common to all roller-based embodiments is that the guiding axle and the wheel axle of a roller suspension means are related to each other in such a way that the rollers changes from a so-called instable position when the chair is loaded asymmetrically into a so-called stable position. Through this transition (dipping movement), the degrees of freedom of the chair's apparatus of motion are reduced. In this way a braking action is produced that characterizes the chairs according to the invention.

Under asymmetrical loading of a chair 1 with rollers 8 according to the invention the rollers 8 automatically assume a position through the dipping movement in which at least two of the rollers 8 point in different directions and thereby brake the entire chair 1 in relation to the floor surface 9.

The effects utilized by the present invention can be clearly observed if the rollers of the chair itself are not braked since the rollers then freely trail given the dipping movement before they return from an instable to a stable position (dipping movement). Moreover, the unrestricted rollers allow for an especially distinctly dynamic up and down movement.

To produce the braking action according to the invention, no silentblocs, brake pads or brake cups that in part reach around the roller are necessary. On the contrary, use of this kinds of braking media may under some circumstances suppress the effects according to the invention.

The dipping movement occurs when the angle of inclination, that is to say the angle of the guiding axle 6.5 changes in relation to the vertical chair axis 11, depending on the loading of the chair 1.

The angle of inclination $\beta$ of the guiding axle 6.5 of the rollers 8 amounts to between $-5$ and 30 degrees in relation to the vertical axis 11. Especially advantageous is an angle of inclination $\beta$ between $-5$ and 10 degrees. In the event the rollers 8 are rounded (as shown in FIG. 12A, for example), the angle of inclination $\beta$ may be smaller than for rollers 8 or cylinders whose edges are less rounded.

Chairs with any number of legs may be realized. Between three and six legs are typically used.

In a further embodiment that is not shown in one of the Figures since it is a variant that may have different embodiments, the chair is designed such that it is given a defined seating direction. This may be achieved, for example, in that the seat may not be turned vis-à-vis the substructure of the chair consisting of the elements 3, 4, 6, and 8. For this purpose, for example, the seat 2 may be designed with a vertical groove in the column 3 that permits a vertical up and down movement, but no turning around the vertical axis 11. If the seating direction is defined, the resilient action of the foot elements may be set differently in the front than in the back. This may make it easier to rock forward with the chair, for example, than backward.

A further embodiment is characterized in that between the vertical column 3 and the legs 4 an adjusting means is located whose starting points may be shifted vertically along the column 3 and/or horizontally along the legs 4, as indicated diagrammatically by double-arrow in FIG. 15. In this way, depending on the position of the starting points, the initial expanding may be set and/or the intensity of the tension. The length of the adjusting means 15 or the hardness/elasticity thereof may preferably be changed, and slots 15.1, 15.2 are provided for shifting. In the area of the starting points, the adjusting means 15 may, for example, be fixed by means of screws or similar fasteners after having been shifted. This type of an adjusting means 15 may be integrated in the column 3 in order to reduce the danger of injury due to jamming.

A further embodiment is shown in FIG. 16. A perspective view onto a foot part 5 can be seen. An embodiment of a spring arrangement for the foot elements 4 is shown. In this embodiment, the foot elements engage a spring steel ring 20 by means of slots or similar provisions. The spring steel ring 20 is placed over a ring-shaped projection of an elastomer spring 17 which seen from below has a disk-shaped element 18. In this embodiment, a shim may be provided which covers the elastomer spring 17 and the spring steel ring 20 from below. The shim may be secured, for example, by means of a screwed connection to the tubular leg 15 that is part of a column 3, or to a tubular leg. The resilient action is produced in this embodiment essential by the special suspension means of the legs 4. The legs themselves can be rigid or resilient in and of themselves.

In FIG. 17, a further embodiment of a spring arrangement for the foot part 5 is shown. In this embodiment, the spring arrangement 17 is designed as a leaf spring arrangement in which one or several leaf springs 19 are arranged in the foot elements 4. In FIG. 17, four leaf springs 19 of different lengths are diagrammatically allocated to a foot element 4. The design, shape, and number of leaf springs 19 are left to the discretion of the person skilled in the art since they are adapted to the corresponding needs. For fixing purposes, the depicted design consisting of a stud-bearing plate 24 with a conical spring washer 25 may be provided. In this case, the stud-bearing plate 24 uses its upper flange 24' and the lower conical spring washer 25 to clamp the inside end of the leaf springs 19 together. On the free end of the bolt 24", there is a screw thread onto which a nut is screwed in order to provide the necessary holding power. The total package can be arranged in a hollow shape of a foot element 4. In this way, it is possible to embed the leaf spring arrangement 18 in plastic or an elastomer material. The resilient action is produced in this embodiment essentially by the special embodiment of the legs 4 which are resilient in and of themselves.

FIG. 18 shows an arrangement in which a conically shaped leaf spring 19 is completely cast in a plastic material with elastic properties. The resilient effect is produced in this embodiment essentially by the special embodiment of the legs 4 which are resilient in and of themselves.

FIG. 19 shows a further embodiment in which the foot element 4 is held by means of a hinge 26 on a pivoting bearing element 27 on the lower end of the leg part 3. In this embodiment, a slot 16 of the foot element 4 may overlap a resilient ring, which for the sake of simplicity is not shown. The resilient action is produced in this embodiment essentially by the special suspension means of the legs 4. The legs 4 in and of themselves may be rigid or resilient.

A next embodiment is shown in FIG. 20 in which the joint struts 26 are replaced by one or several springs 26'. In this variant, the foot element 4 with a slot may overlap a seat, for example, as shown in FIG. 12A, an axle bolt 14', which may be fixed or held flexibly by means of a suspension means 14". The cover cap 17 may prevent jamming. The resilient action is produced in this embodiment essentially by the special suspension means of the legs 4. The legs 4 in and of themselves may be rigid or resilient.

A next embodiment is shown in FIG. 21. In this case, a return force is produced by compression springs 19 which are arranged between a perpendicular leg of a foot element 4 and a tubular leg 3. In a swiveling movement, the compression spring 19 is compressed and thereby creates a return force. In this embodiment, instead of a compression spring, an elastomer material may also be used. The resilient action is produced in this embodiment essentially by the special suspension means of the legs 4. The legs in and of themselves may be rigid or resilient.

In FIG. 22, a further embodiment of the invention is shown. In this embodiment, the foot part 4 is divided into a flexible part 4' and a rigid part 4". The flexible part 4' is hinged and located on the rigid part 4". A spring arrangement 19 is formed between the two parts 4' and 4". In the example shown, a hinge 44 is provided for on the underside of the foot element 4 that serves as a hinged joint between the flexible part 4' and the rigid part 4". The surfaces of part 4' and 4" which are disposed in opposite relationship and thus face each other together define a V-shaped cut-out into which a compression spring 19 is fitted. When the chair 1 is loaded, the flexible portion 4' pivots against the elastic force of the compression spring 19 and in that way is subjected to a return force. The resilient action is produced in this embodiment essentially by the special embodiment of the legs which are resilient in and of themselves.

The misalignment between the guiding axle 6.5 and the wheel axle 8.1 which is here referred to as excentric seating, typically amounts to between 0.5 cm and 5 cm according to the invention. A misalignment between 1 cm and 3 cm is particularly advantageous. Selection of the suitable misalignment is important since the inventive effects of the braking action do not occur when the misalignment is too small or too great. When the misalignment is too great, safety problems may arise, in particular when the guiding axles exhibit a negative P inclination that is too great since in this case the rollers are too close together in an unloaded state. Rollers are particularly suitable which have a diameter between 1 and 8 cm. In this case, rollers with a diameter between 2 and 5 cm are particularly advantageous.

Depending on the embodiment and the selection of the different parameters, there is a synergistic effect produced by the positive interaction of the individual chair components. The individual chair components are the resilient legs, for example brought about by the effect described in connection with the drawings 5A, 5B, 6A, 6B or 7A, 7B.

A chair according to the invention may also have supporting elements (for example rollers) which only demonstrate the described braking effect through the resilient legs.

A chair according to the invention not only demonstrates the described braking effect, in the event rollers are used, it also generally increases its supporting surface when loaded and, through the ability of the rollers to run or the gliding qualities of the gliding elements it provides a virtually frictionless and safe up and down movement parallel to the vertical axis 11. Through the combination and interaction of these effects, a chair may be provided that is meets all demands in terms of safety, dynamics, health and comfort.

FIG. 23 shows in an axial sectional view a further embodiment of a rocker stool 1 with a seat 2, a leg part 3 and with foot elements 4 which extend radially from a foot part 5. In the representation, three such foot elements 4 can be seen. In the realized embodiments, any number of such foot elements may be arranged on a foot part, standard are between four and six. A spring arrangement 6 is fixed on the leg part 3 which allows for an up and down swinging of the seat part 2 on the foot part. In the depicted embodiment, the foot elements have rollers on their free ends. This, however, is an embodiment variant which is not necessary since there are also rocker stools of this type that stand on sliding feet. The foot part located in the lower portion of the leg part 3 has a holding arrangement 10 on which the foot elements 4 are largely individually mounted and seated to swing up and down.

In the foot part 5, a second spring arrangement 9 is provided that interacts with the holding arrangement 10. The holding arrangement 10 in the embodiment shown has holding segments 10' distributed over a periphery of 360° and which define a free cross-section and which are equally spaced from each other. In the illustrated embodiment, the spring arrangement 9 consists of an elastomer ring which is inserted into the free cross-section and which is cylindrical in the lower portion and which flares conically outward in the upper portion. For that purpose the holding segments 10' have a correspondingly conical flattened portion. In the spacing between the segments 10' is a pivot pin 14 on which the foot elements 4 are hookingly engaged as will be described in greater detail hereinafter. Into the free cross-section of the opening of the elastomer ring in the foot part 5 is inserted the lower section of the leg part 3, and on its side which faces the floor, connected to the foot part with a locking tappet 13.

In the embodiment illustrated in FIG. 23, the leg portion 3 has a support plate 11 against which the first spring arrangement 6 can bear. The support plate 11 is fixedly disposed on the tube 10 of the leg part 3.

The elastic force of the spring arrangement 9 is adjustable by means of an adjusting device 7 to a respective user of the seat. In the case of the spring arrangement used in connection with the embodiment described hereinafter with reference to FIGS. 26 and 28 this adjusting device 7 also serves for adapting the return force to the extent of the desired rocking movement.

FIG. 24 is a perspective view from below of a rocker stool. This is therefore a view from below on to the foot part 5 with the closure portion 13.

Attention is now directed to FIG. 25 showing a diagrammatic view of the arrangement of foot elements 4. Provided in the foot elements 4 at the ends thereof towards the leg portion are slots 16 which are open downward. The foot elements 4 are put into the slots 16 by means of the pivot pin 14. The inward end faces of the foot elements 4 are provided with an inclined surface indicated at 4', with which they bear against the conical outside surface 9' of the cone formed on the spring element 9. Arranged at predetermined intervals above the backs of the foot elements 4 is a cover cap 17, comprising resilient material. Disposed under the cap are rollers 38 against which the backs of the foot elements 4 bear and along which they roll upon swiveling movement thereof. Since the cover cap 17 is essentially fixed in respect of translatory movement in the axial direction of the leg part, it applies a return moment to the respective foot elements 4 when they perform a pivotal movement in an upward direction.

Figure 26:
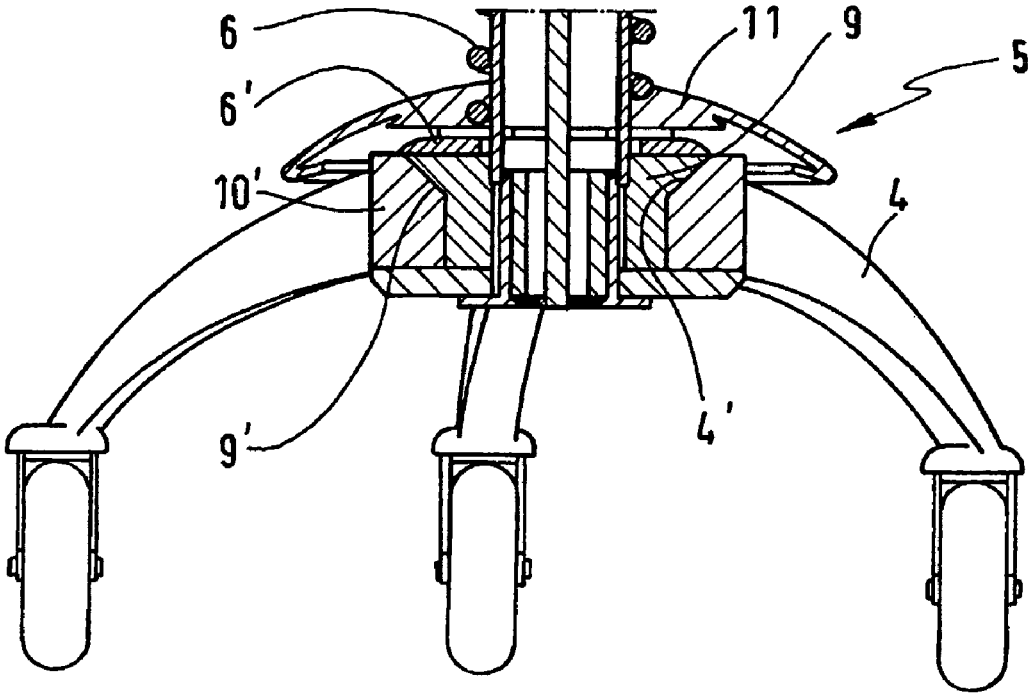

FIG. 26 shows a further embodiment of the spring arrangement 9. In this case, the spring arrangement 6 is also primarily involved in the upward and downward swinging movement of the stool is also operative in terms of providing the elastic forces for the return moments which act on the foot elements 4. For that purpose the spring 6 is supported by way of the support plate 11 against a transmission plate 6' on the ring comprising holding segments 10'. When a foot element 4 performs a pivotal movement upwardly, the inclined surface portion 4' thereof presses against the conical spring mass of the ring 9 and displaces that material upwardly, and the material seeks to expand and in turn presses against the plate 6' which is supported against the support plate 11. However, since that support plate 11 is spring-loaded, a foot element 4 which is pivoted upwardly is accordingly subjected both to the return force afforded by the spring arrangement consisting of the material 9 and also the force of the spring arrangement 6, so that the base element 4 is thereby forced back in the original direction. In this embodiment, the support plate 11 is axially displaceable along the tube 15 of the leg portion 3. In this embodiment the support force which has previously been afforded by the axially fixed plate 11 is afforded by the holding segment arrangement 10.

Figure 27:
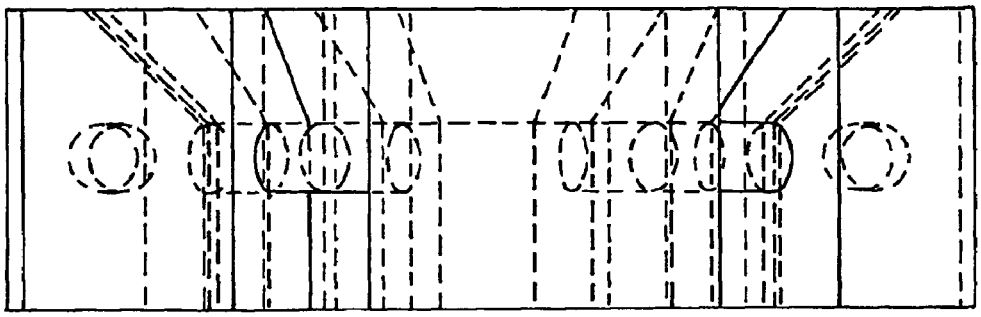
Figure 27:
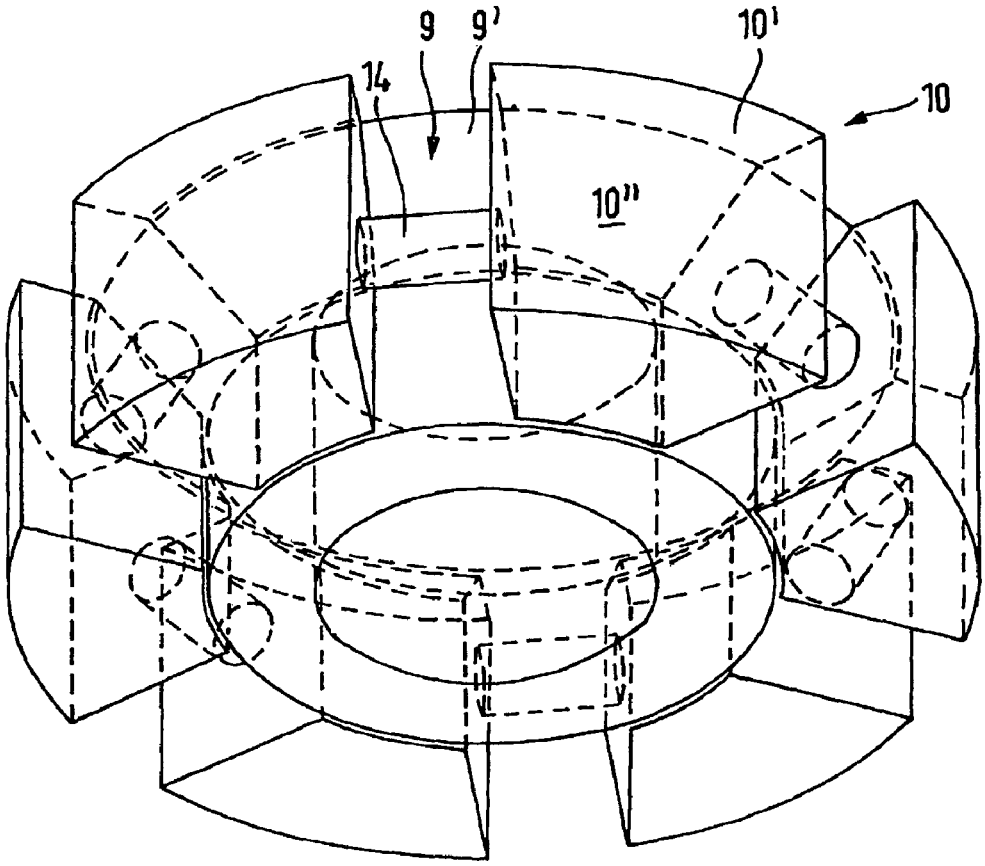

In FIG. 27, a perspective view of the holding arrangement 10 with six holding segments 10' and an inserted annular elastomer spring arrangement 9 is shown.

As already discussed in connection with FIG. 23, in the illustrated embodiment the holding arrangement consists of holding segments 10' which are arranged in a ring configuration and which are each at a predetermined spacing from each other, as measured in degrees of angle. Provided between the individual holding segments is a respective holding arrangement, in the illustrated embodiment being a pin portion 14. The pin portions 14 which are each inserted into the regions of the respective spacings hold the holding segments 10' together to form a holding ring. At the inner edge the holding ring, at each of the holding segments 10', is a respective inclined surface 10" which, considered in the generality of all holding elements, form a conical contact surface for the conical upper region 9" of the elastomer spring ring 9. Accordingly in the illustrated embodiment, the elastomer spring ring 9 is in the form of a one-piece elastomer ring which in its lower section is surrounded by the cylindrical subsections of the holding segments 10', that is to say it bears against the cylindrical subsection of each of the holding elements 10' and in its upper section has a conical enlargement which bears against the conical surface portions 9'.

In the embodiment depicted in FIG. 26, the plate 6' is essentially of a diameter such that it is supported in the region of the upper inner edges of the holding segments 10'.

Figure 28:
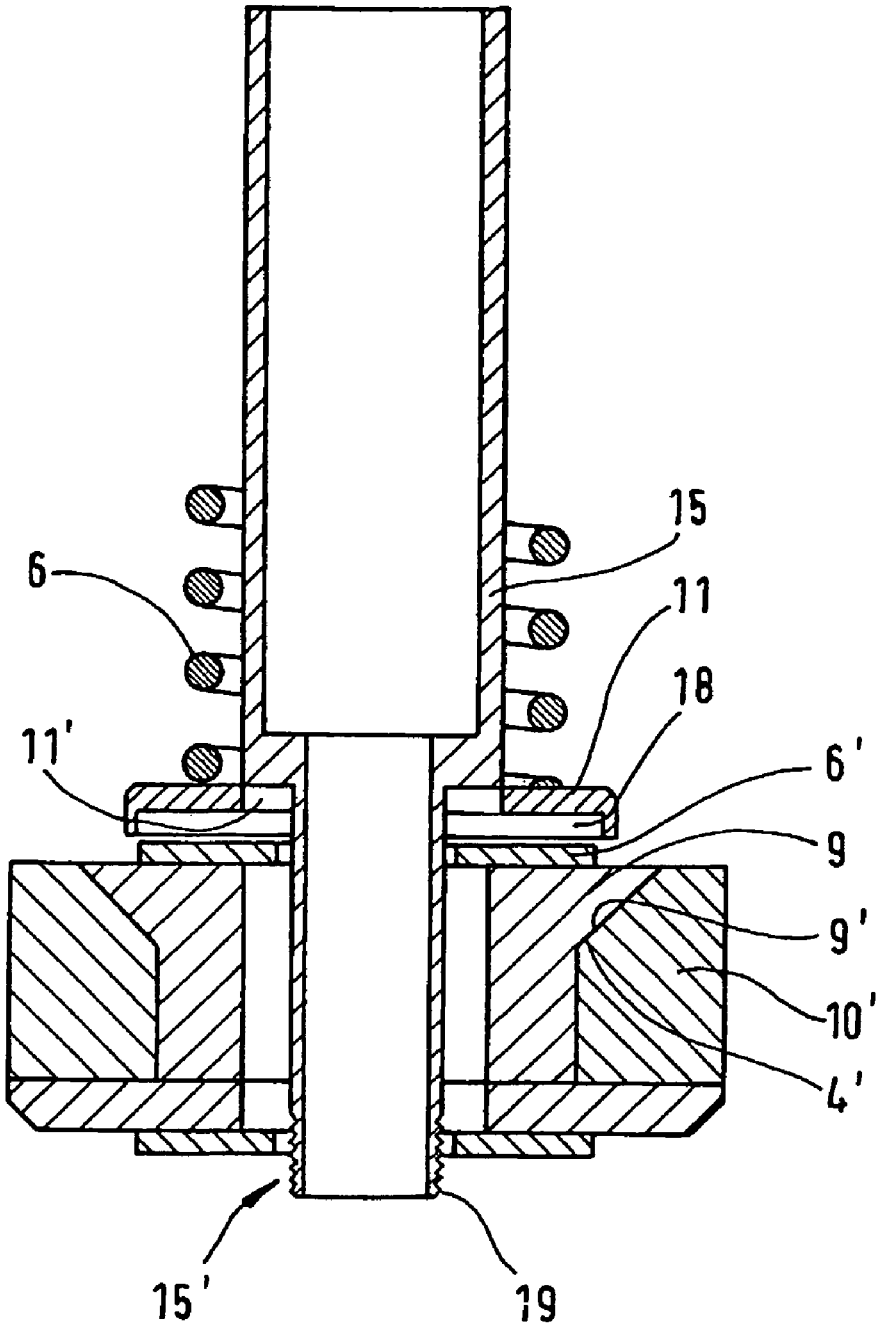

In contrast, in the embodiment shown in FIG. 28 in which the tube arrangement of the leg portion 3 and the foot portion 5 are shown in a detail sectional view, the support surface area of the spring 6 against the rubber-elastic material of the spring arrangement 9 is substantially less. The diameter of the plate 6' is slightly smaller than an opening in the support plate 11 disposed thereabove. Provided in the support plate 11 is a bore whose internal width is such that the tube 15 of the leg part 3 can pass therethrough and, when a corresponding loading is applied, it can sit on the plate 6'. That arrangement provides that, upon maximum compression of the spring, the leg part adopts a softly resilient abutment position.

In the case of a rocking movement, that is to say when a foot part (not shown) is lifted the elastic material 9 is forced upward and consequently the plate 6' is displaced into the opening in the support plate 11. An elastic intermediate layer can be disposed between the plate 6' and the support plate 11. This embodiment permits cardanic mounting of the tubular leg which is passed with a tube projection 15' through the elastic ring 9 and is fixed at the lower side of the holding arrangement 10 to the holder by a means of a screw. In this case, a screw means (not shown) is supported by way of a shim arrangement against the holding arrangement 10.

Figure 29:
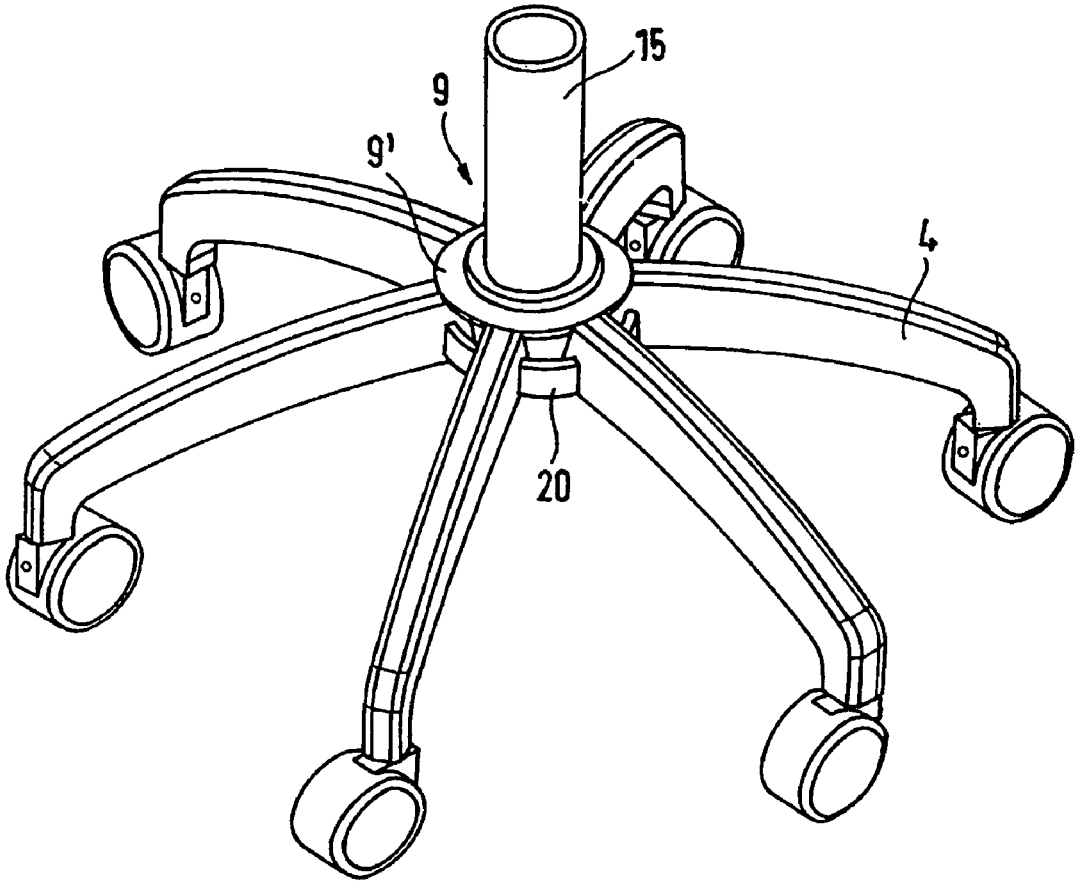
Figure 30:
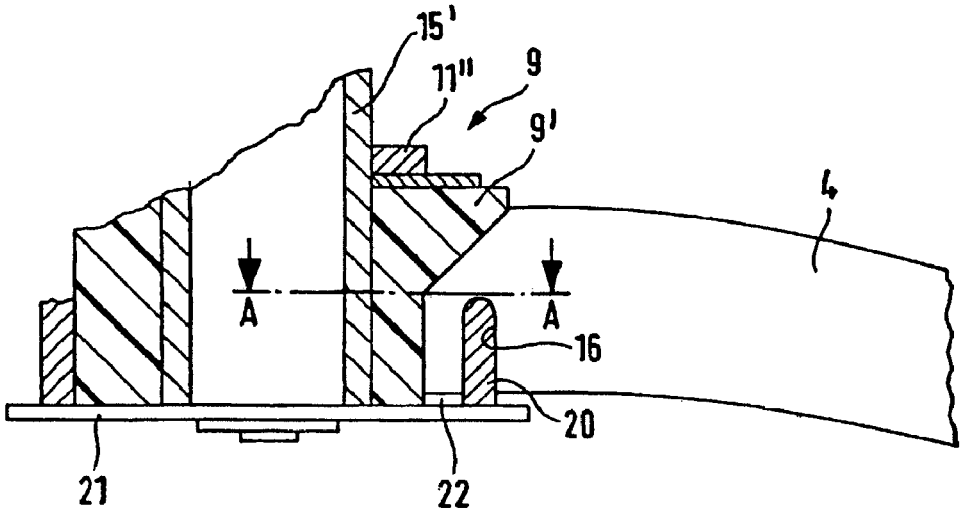
Figure 30A:
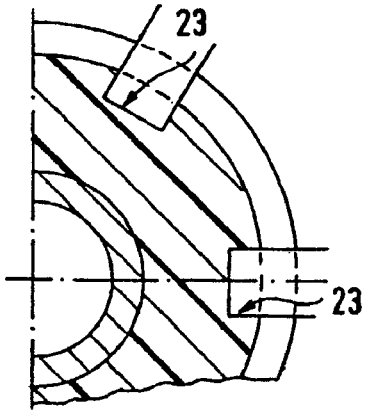

FIG. 29 shows a further embodiment of a spring arrangement for the foot elements 4. In this embodiment the foot elements 4 engage a spring steel ring by means of the slots 16. As can be clearly seen from FIG. 30 to which reference is now also directed, the spring steel ring 20 is fitted over the annular projection and terminates flush therewith at the lower edge. This embodiment also includes a shim 21 which covers the elastomer spring ring 9 and the spring steel ring 20 from below. The shim is secured by screw means to the tubular leg 15 or to a tubular leg 15'. Fixed to the tubular leg 15' is a lock disk 11" which provides support for the elastomer material as it is subjected to deflection in operation of the arrangement.

The foot element 4 preferably has a bevel 22 at a lower edge thereof which is between the slot 16 and the end of the foot element 4, which is towards the leg portion. The bevel 22 allows the foot element 4 to pivot upward without acting against the shim 21.

In an embodiment not depicted, the foot element 4 may include a radially protruding projection which is formed at the end towards the leg portion and which, instead of with inclined surfaces with a downwardly directed surface portion, exerts on the elastomer spring ring 9 a pivoting force which is directed substantially perpendicularly downwardly. In such an embodiment the elastomer ring 9 can be in the form of a simple elastic tubular sleeve of suitably thick wall thickness which carries the pivotal force by means of its upwardly directed end wall.

At the locations at which a foot element 4 engages over the spring steel ring 20, provided on the elastomer ring 9 is a suitable opening 23 in order to permit the slot 16 to engage over the spring steel ring 20.

Figure 31:
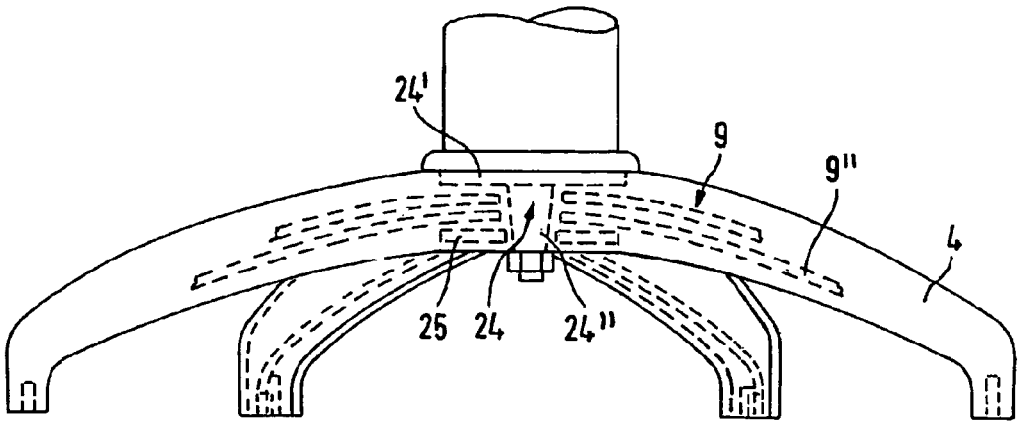

FIG. 31 is a further embodiment of a spring arrangement for the foot part 5. In this embodiment the second spring arrangement 9 is in the form of a leaf spring arrangement in which one or more leaf springs 9" are disposed in the foot elements. In FIG. 31, the four leaf springs 9" of different lengths are allocated in the diagram to a respective foot element 4. The configuration, shape and number of the leaf springs 9" are left to the discretion of the person skilled in the art since they are adapted to the corresponding needs. For fixing purposes, the illustrated construction can consist of a stud-bearing plate 24 held in place by a clamping disk 25. In that configuration the plate 24 with its upper flange 24' and the lower clamping disk 25 clamps together the inwardly disposed ends of the leaf springs 9". Provided at the free end of a stud 24" is a screw thread, on to which a nut is screwed in order to apply the necessary holding force. The overall pack is disposed in a hollow cavity in a foot element 4. In that way it is possible for the leaf spring arrangement 9 to be embedded in suitable plastic material or an elastomer.

Figure 32:
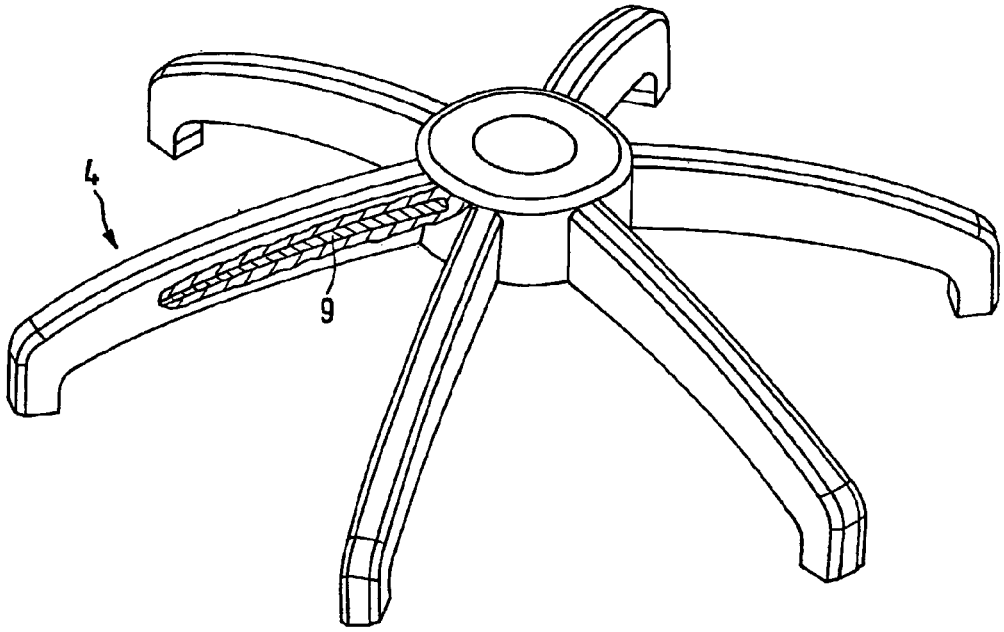

FIG. 32 shows an arrangement in which a leaf spring 9 of a generally conical configuration is disposed in a foot element and encased completely by plastic material having elastic properties.

Figures 33, 33A:
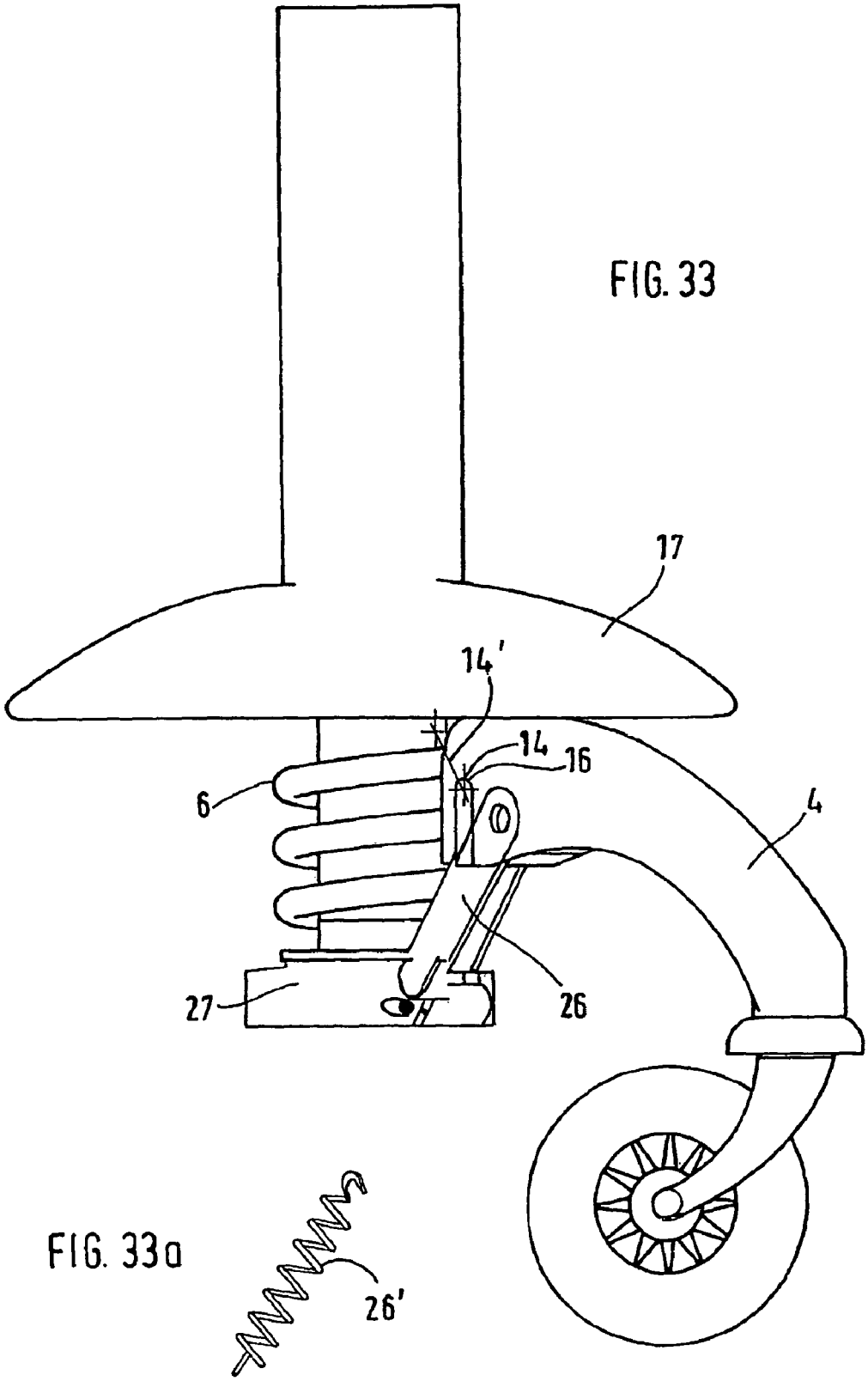

FIG. 33 shows a further embodiment in which a base element 4 is held by means of a pivot 26 to a pivot mounting element 27 at the lower end of the leg part 3. In this embodiment a slot indicated at 16 in the foot element 4 can engage over a spring-elastic ring which is not shown herein for the sake of simplicity.

Another embodiment is shown in FIG. 33*a*, wherein the pivot 26 formed by pivot struts is replaced by one or more springs indicated at 26'. In this alternative configuration, the foot element 4 can engage with a respective slot 16 over a mounting arrangement as is shown for example in FIG. 23 in the form of a pivot pin 14 which can be held fixed or flexibly mounted by means of a suitable mounting.

Figure 34:
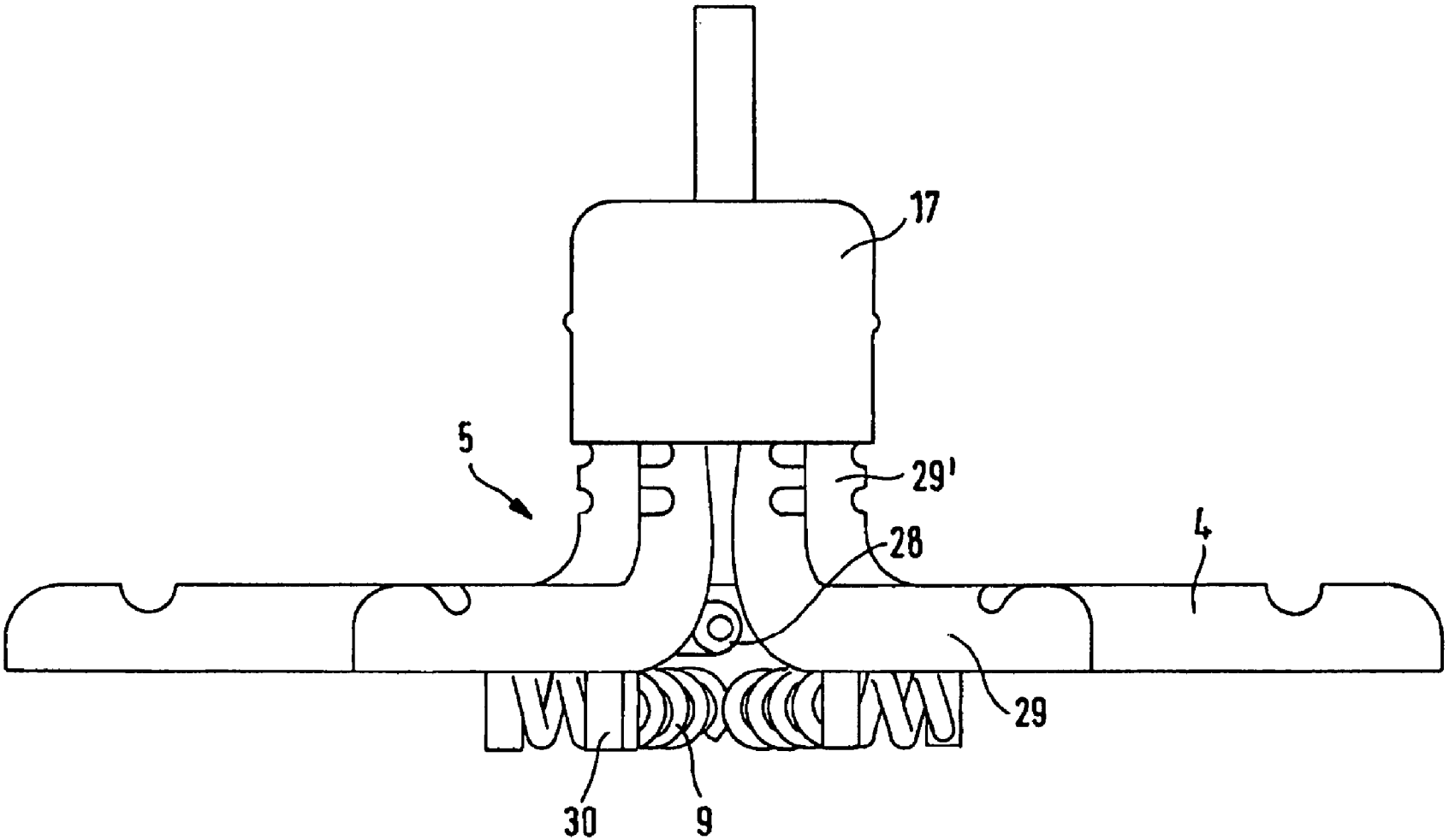
Figure 35:
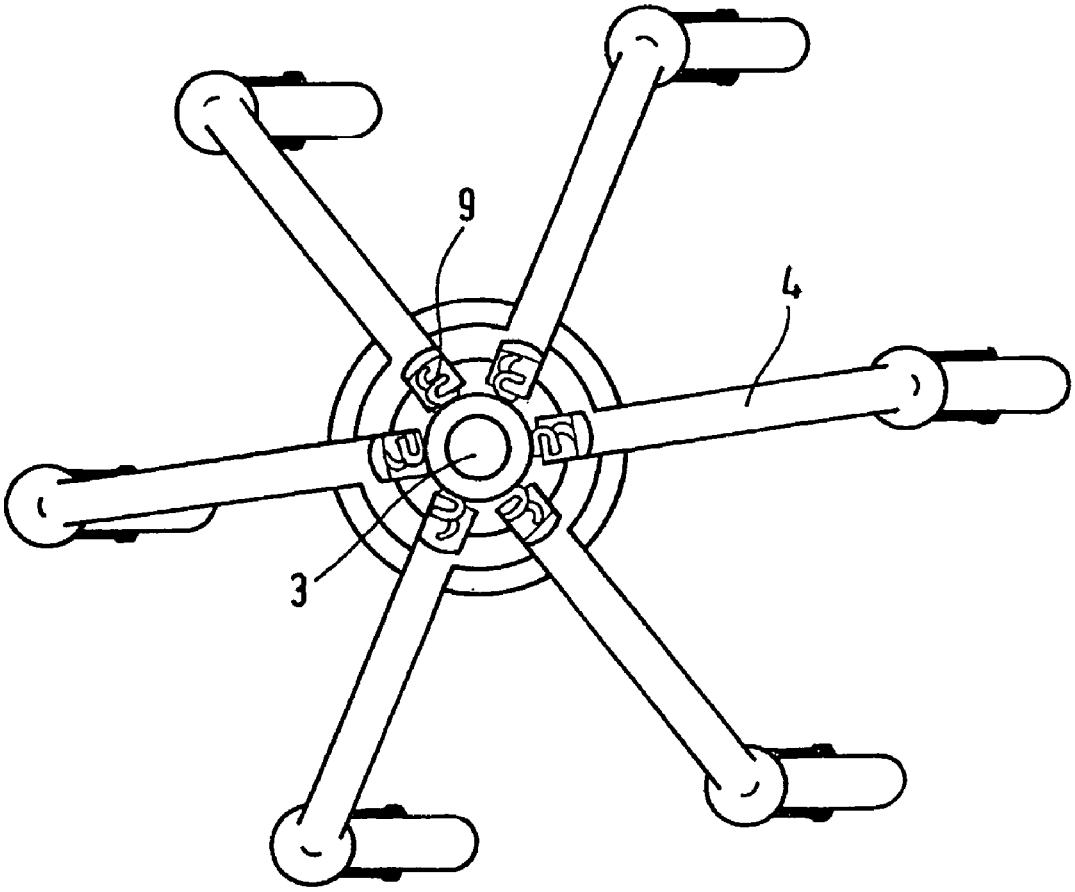

FIG. 34 shows a further embodiment by way of example of a spring arrangement 9 on the foot part 5. In this embodiment the foot elements 4 are substantially in the shape of an L comprising a generally horizontally extending floor leg 29 and a generally perpendicularly extending leg 29'. The horizontal leg 29 is longer than the vertical leg 29'. Provided in the region of the angle between the legs 29 and 29' of the foot element 4 is a spring arrangement 9 which on the one hand engages a corresponding holding projection 30 disposed under the horizontal leg 29 of the foot element 4 and which on the other hand engages the leg part 3. In addition, each one of the foot elements 4 is held pivotably by way of a suspension means 28 in the above-mentioned region of the angle. Upon pivotal movement, the foot element 4 is forced upward and thus rotates about the suspension means 28. In that situation, the return force applied by the spring arrangement 9 is operative at the same time to produce a return moment in opposition to a pivotal or rocking movement of the seat.

All upwardly directed legs are covered by a cover cap indicated at 17 and thereby safeguards against articles or the like from being unintentionally clamped therein.

In FIG. 13, an alternative configuration of the embodiment illustrated in FIG. 12 is shown. Here, the return moment is not produced by tension springs 9 disposed under the foot elements 4, but by compression springs 9 arranged between the vertical leg of each of the foot elements 4 and the tubular leg portion 3. Upon a pivotal movement of a foot element 4 the compression spring is compressed and thereby produces a return moment. In this embodiment, instead of a compression spring, it is also possible to use elastomer material.

Figure 36:
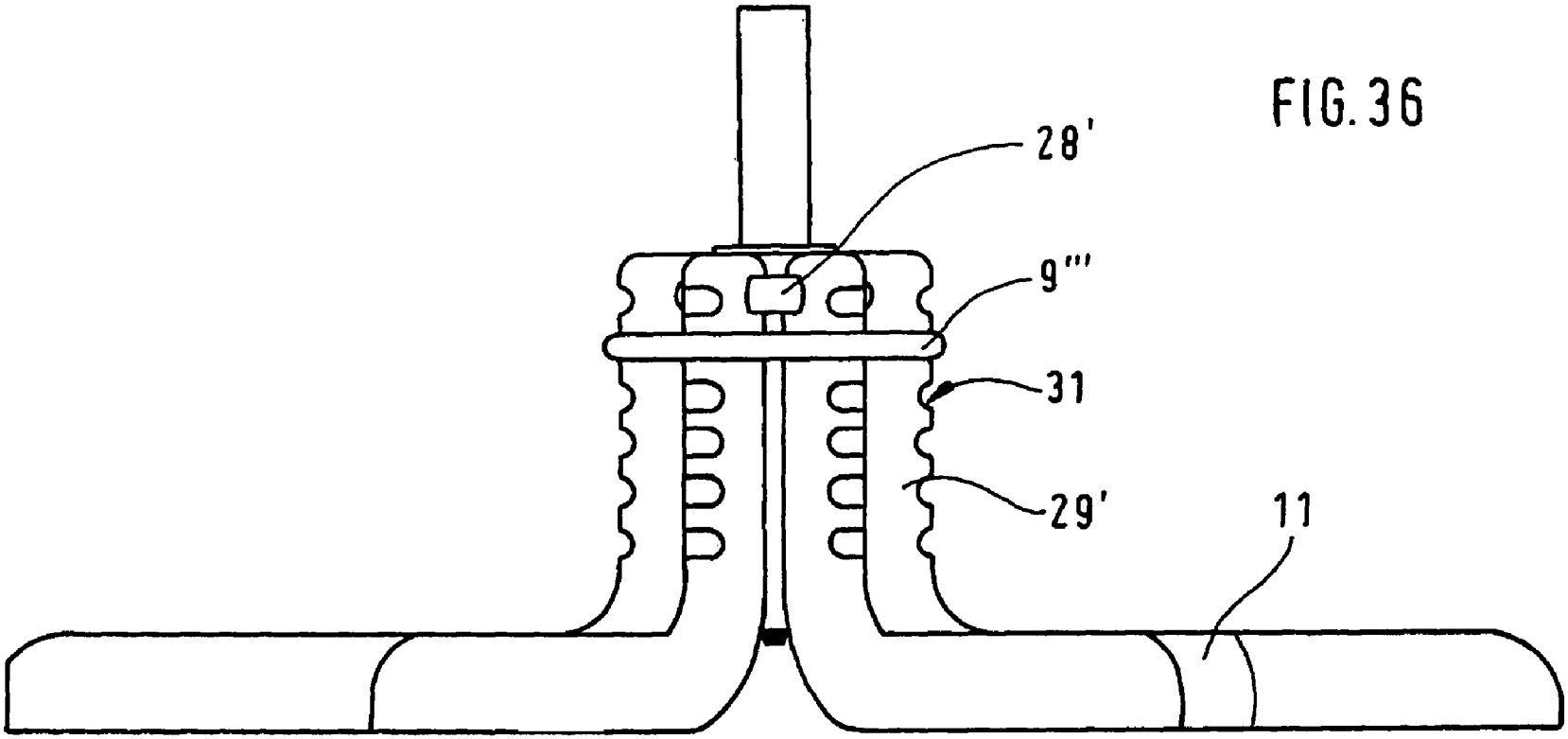

FIG. 36 shows a further alternative configuration of the embodiment shown in FIG. 34 in which the upwardly projecting legs of the foot elements 4 are held at their upper ends by means of a suspension device 28'. The return elastic force is afforded by a resilient ring 9''' which is fitted at the outwardly directed back of each of the vertical legs of the respective foot elements 4, in mounting grooves 31 provided at that location. In order to vary the magnitude of the return moment the ring 9''' can be arranged at different levels. In that way, a greater or smaller spacing relative to the suspension device 28' provides a greater or smaller return moment. The closer the ring is positioned to the suspension device 28', the lower is the level of the return moment while conversely the return moment is increased with a greater distance to the suspension device.

In addition to the elastic ring 9''', it is also possible, as shown in FIG. 34, for a cap 17 comprising resilient material to produce a resilient return moment if, in the embodiment shown in FIG. 36, it is screwed over the upwardly projecting legs 29' of the foot elements 4. Upon deflection of a foot element 4 outwardly it bears against the downward edge of the cap 17 and, upon further progress in the rocking movement, it has to overcome the return moment produced by that elastic cap 17.

Figure 37:
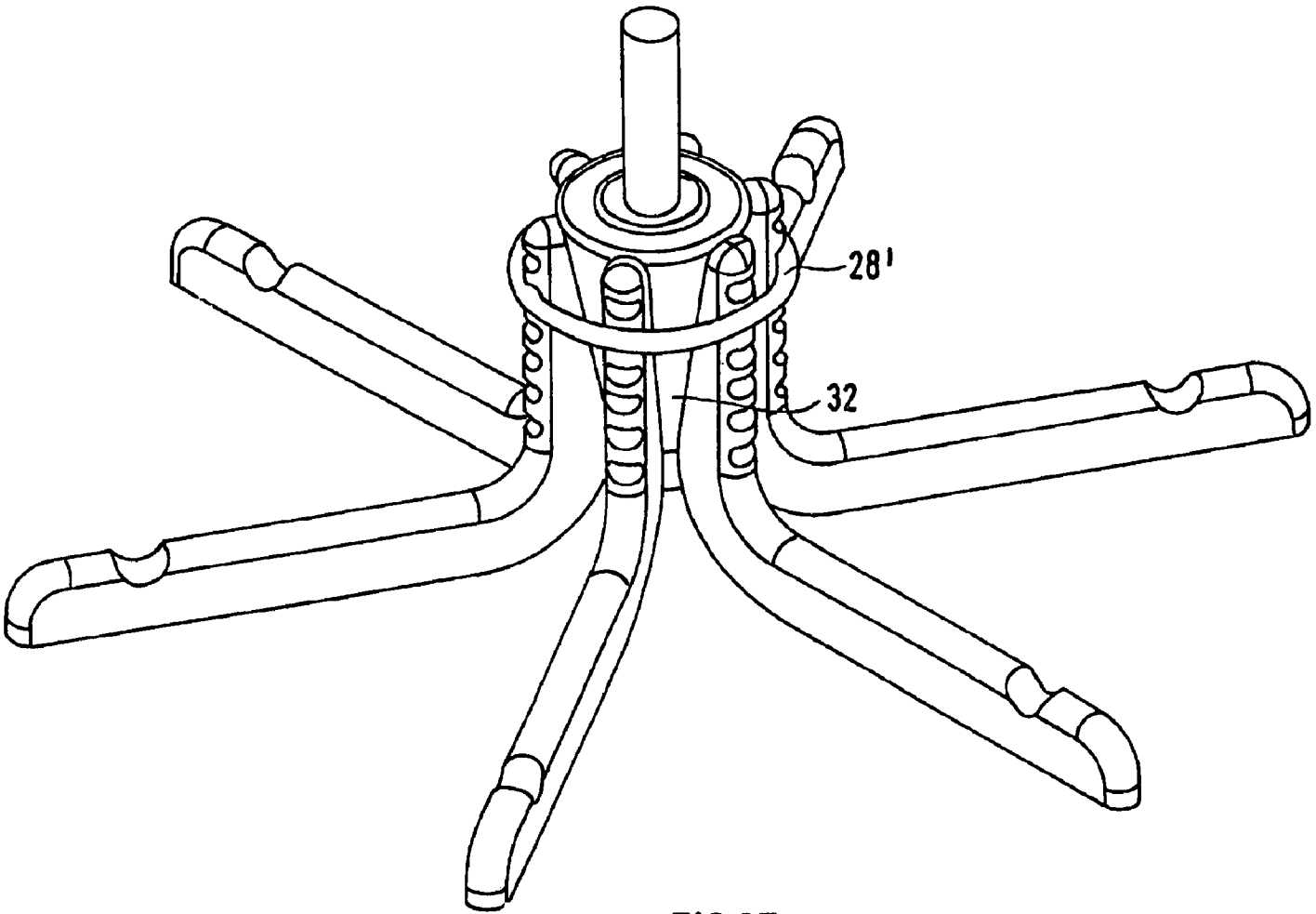

FIG. 37 shows a further embodiment in which the upwardly projecting legs of the L-shaped foot elements 4 bear at their inwardly directed edges against a central cone or wedge portion 32. That central wedge portion is displaceable axially in the direction of the leg part and permits precise initial angular setting of the rollers carried on the foot elements 4. A suitable suspension arrangement holds the foot elements appropriately in position.

Figure 38A:
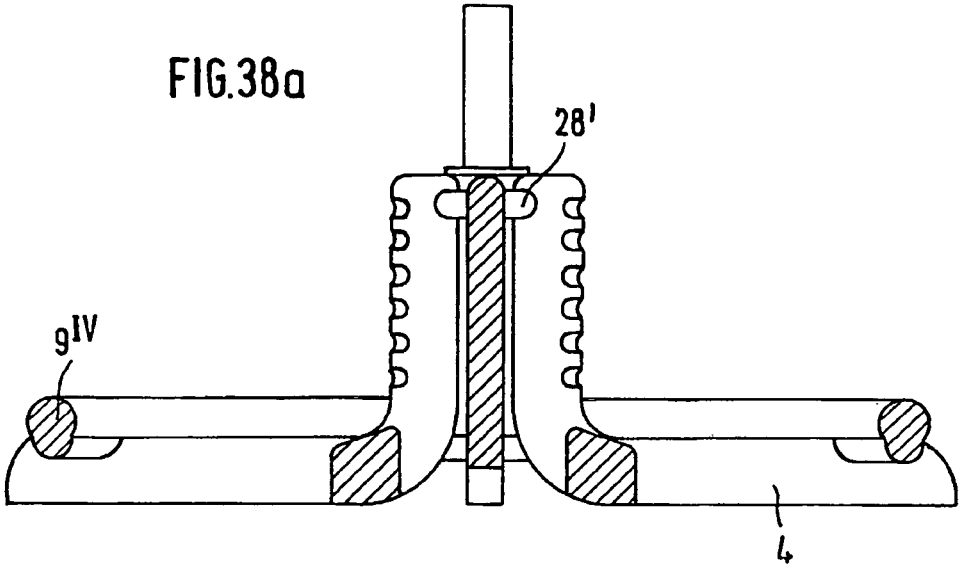
Figure 38B:
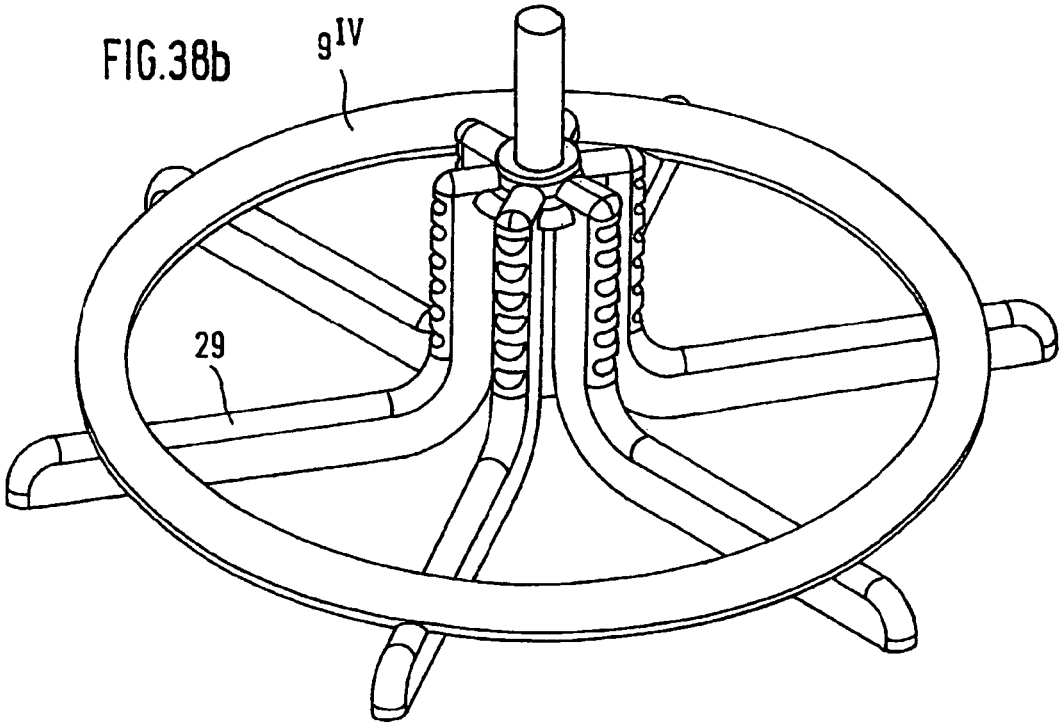

FIGS. 38*a* and 38*b* show a further embodiment of the L-shaped foot elements 4. In this arrangement the elastic force for the return moment for the foot elements 4 is afforded by a spring ring $9^{IV}$ which is arranged substantially in the form of a foot ring on the backs of the horizontal legs 29. The diameter of that spring ring $9^{IV}$ is so selected that it comes to bear substantially against the outwardly disposed portions of the foot elements 4.

The cross-section of the foot ring $9^{IV}$ can be of a particular configuration in order to provide a desired return force. In the embodiment shown in FIG. 38 the spring ring $9^{IV}$ in cross-section is of a for example approximately egg-shaped configuration which in itself provides a return moment for the ring, which is high in relation to the cross-section. It is however also possible to use a ring which lies flat and which in consequence has a softer return spring characteristic.

Consideration will now be given to a further embodiment illustrated in FIG. 39 and 40 in which the foot part 5 is formed by an elastic hollow body 33, to the outsides of which the foot elements 4 are essentially rigidly secured. In this embodiment as illustrated, the hollow body 33 is preferably of a generally spherical configuration. The cavity 34 within the hollow body 33 can be put under pressure by way of a valve 35 and the outside wall of the hollow body 33 is elastically deformable, whereby it is possible for a foot element 4 secured thereto to perform substantially three-dimensional pivotal movement.

Figure 41:
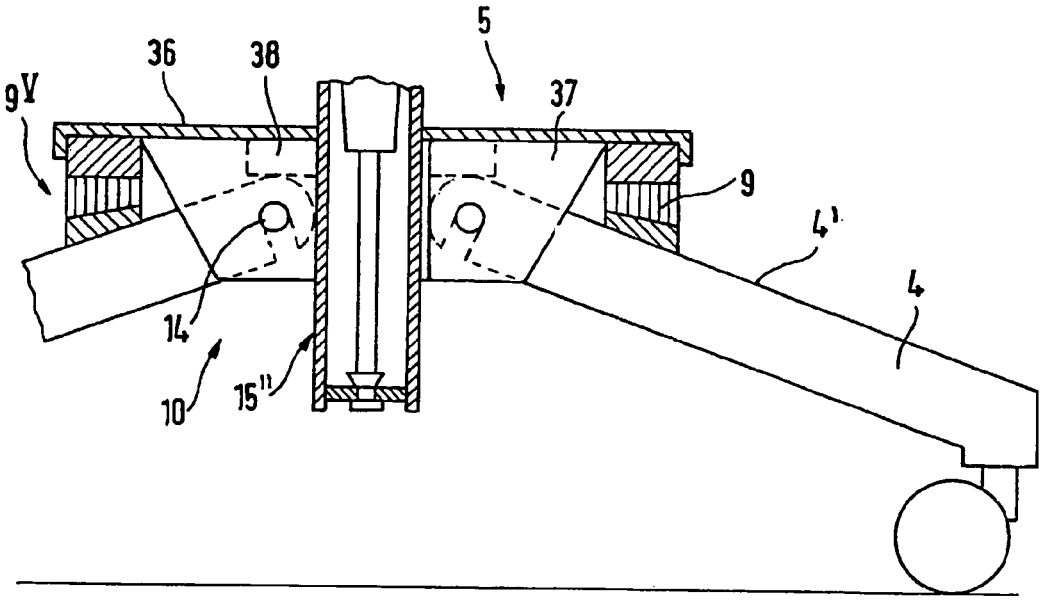

FIG. 41 shows a further embodiment of a foot portion 5. In this embodiment, the holding arrangement is secured directly to a tubular projection 15' of the leg part 3. The tubular portion 15' has a holding disk 36, at the underside of which are provided holding limbs 37, between which the pivot pins 14 are respectively fixed. Fixed in the region of the outer periphery under the holding disk 36 is a disk-shaped spring arrangement 9, against which the backs 4' of the respective foot elements 4 bear. Provided at a spacing above the pivot pins 14, under the holding disk 36, is an abutment 38 which ensures that the foot element 4 cannot become disengaged from the respective pivot pin 14 during dynamic tilting movements of the seat.

The spring arrangement 9 in the embodiment consists of a spring ring $9^{V}$ which is of a three-layer structure. Those three layers can involve any combination of elastomer materials of differing hardness or softness, while for example the lowermost layer may be made of a non-elastomer material, the surface thereof being that which co-operates with the ends of the respective foot elements 4. As shown in FIG. 20, the contact surfaces of at least two layers may be of a specifically adopted geometry, which makes it possible, by rotation of the layers in question, through a predetermined angle, to set a respectively different spring characteristic for the spring ring.

In the set position shown in FIG. 42, the elastomer ring $9^{V}$ is made of an elastic material is of the greatest elastic strength. If now the uppermost layer of the spring ring is turned through so many degrees of angle that the two layers are disposed in mutually opposite relationship displaced by half the length of the respective ramp configurations, then it is possible for the elastomer material of one layer or, if both layers involve such an elastomer material, also the second of the layers, to be deflected partially into the free space which results in the spring ring overall having a softer spring constant.

In a particular embodiment those contact surfaces of a particular configuration, which in FIG. 42 involve a coarse sawtooth pattern, can additionally be provided with a very fine sawtooth pattern, thereby preventing a spring disk which has been rotated into a predetermined position from being rotated back again, by virtue of the dynamic movement.

An alternative configuration for such an elastomer ring 9 as is used in the embodiments as per FIGS. 41 and 42 can provide for employing a rubber tube, the hardness of which can be regulated by having a higher or lower air pressure therein.

FIG. 43 shows a further embodiment of the invention in which a holding arrangement 10 is also provided on a sleeve on a tubular portion 5' of the tubular leg portion 3. The foot elements 4 are arranged pivotably about the pivot pins 14 on the sleeve. Arranged on the end face of the foot element 4, which is towards the leg, is a pressure plate 39. Upon an upward pivotal movement of the foot element 4, that pressure plate 39 pivots in a direction towards the tubular portion 15. At the level of the operating region of the pressure plate 39, an elastomer ring 9 is disposed around the tubular portion 15 so that, depending on the respective degree of pivotal movement, the pressure plate 39 compresses the elastomer ring 9 to a greater or lesser degree. That elastic deformation exerts a return moment on the pressure plate and thus on the foot element 4 connected thereto.

In the embodiments depicted in FIG. 43-45, arranged at the radially outwardly disposed ends of the foot elements 4 are stoppers 40 which are disposed radially outside of the contact areas between a floor surface and a respective roller 8.

While, in the embodiment illustrated in FIG. 43, the stopper 40 is arranged rigidly on the foot element 4, the stopper 40 in the embodiment illustrated in FIGS. 44 and 45 is an integral part of the roller mounting arrangement, that is to say the stopper 40 forms a prolongation of the rotational axis 42 about which the roller 8 can be pivoted. That causes a change in the relative position of the stopper 40 with respect to the roller 8, that is to say when the roller is pivoted radially outwardly, the stopper is disposed between the roller/floor contact area as indicated at 43, and the center of the stool, while when the roller is pivoted inwardly, the stopper 40 is outside that dimension; if the roller is pivoted inward, the stopper 40 is outside of this dimension. The end region of the foot element 4 or the roller mounting arrangement can be adapted to be soft or pivotable as far as a given amount, so that, upon a rocking loading being applied to the seat, the rollers 8 rotate away so that the stoppers 40 can come into contact with the floor. That affords a braking action and the seat cannot roll away.

In the embodiment illustrated in FIG. 46, the stopper 40 is always disposed rigidly within the spacing between the center of the seat and the support roller. By virtue thereof, the stopper 40, with its rubber knob 41, can always come into contact with the floor when the angle of inclination of a rocking movement of the seat, in a direction towards the foot element 4, exceeds a given number of degrees. The reason for this is that, in a rocking movement in a forward direction, the pivot point of the suspension mounting of the foot element 4 on the holding arrangement 10 approaches the floor and a relative upward pivotal movement of a foot element 4 takes place, but the angle between the foot element 4 and the floor becomes less. The stopper 40 is also within the spacing center of stool/roller, namely directly next to the tubular leg 15 in the embodiment shown in FIG. 47. The stopper 40 takes the form of a protective cover the outer edge of which touches the floor given the corresponding inclination of the leg part (3).

This particular stopper arrangement represents a safety device which ensures that, during excessive rocking movement, the seat does not roll away from under the user of the seat, in a direction opposite to the rocking movement. In comparison therewith the stopper arrangement which is disposed radially outside of the contact area 43 provides a larger angle between the foot element 4 and the floor so that, by virtue of that inclined positioning, the outwardly disposed stopper 40 comes into contact with the floor and thus retains the seat in position in relation to the floor. That effect also occurs in relation to the foot elements which are disposed in opposite relationship to that in whose direction the rocking movement is performed. These modified foot elements also adopt a steeper angle relative to the floor surface, whereby the outwardly disposed stopper 40 comes into contact with the floor.

It is expressly pointed out that any combinations of the embodiments described are possible and thus the implementation of combinations of structures which are not so described does not constitute a departure from the extent of protection provided by the present patent. Thus for example it is possible for the stopper device to co-operate with any desired structure of a spring arrangement and the stopper is therefore not limited to the embodiments of FIG. 43.

Reference is now made to FIG. 48 showing a further embodiment in which the stopper is pivoted by means of an actuating structure 44 during the rocking movement, in a forward direction, and forms an area of contact with the floor. For that purpose the stopper 40 is mounted pivotably.

Reference is finally made to FIG. 49 showing a further alternative embodiment of the invention in which the foot element is subdivided into a flexible part 4' and a rigidly mounted part 4". The flexible part 4' is arranged pivotably on the rigid part 4". A second spring arrangement 9 is provided between the two parts. In the illustrated structure arranged on the underside of the spring element 4 is a pivot 44 which serves as a hinge between the movable portion 4' and the rigid portion 4". The end faces of the portions 4' and 4", which are disposed in opposite relationship and thus face towards each other, together define a V-shaped cut-out into which a compression spring 9" is fitted. When a rocking loading is applied to the seat the movable portion 4' pivots against the resistance force of the compression spring 9" and in that way is subjected to a return moment.

It will be appreciated that this embodiment is not restricted to the compression spring 9" disposed in the V-shaped cut-out. Thus, instead of a compression spring of that kind, it is also possible to provide a leaf spring. In such a situation the V-shaped cut-out permits unimpeded relative rotary movement of the two portions 4' and 4" relative to each other.

In principle it is possible to adopt any spring structure which makes it possible to exert a return moment between the portions 4' and 4" when the movable portion 4', as a result of the rocking movement, performs a relative pivotal motion with respect to the fixed portion 4".

The invention claimed is:

1. A chair comprising:

a seat part, at least one leg part, at least one foot assembly including a plurality of foot elements, and at least one first spring arrangement provided at the leg part, wherein at least one of the foot elements is provided movably and is subjected to an action of a resilient return moment upon loading thereof, the plurality of foot elements are arranged in a star shape, the at least one of the foot elements is pivotable up and down, at least one second spring arrangement engages the at least one foot element, in a lower section of the at least one leg part, at least one holding member is formed, on which at least one of the foot elements is accommodated, at least one of the foot elements is suspended on the at least one holding member and held in its position by at least one retainer, the plurality of foot elements always support an entire load placed on the seat part; wherein on an end of at least one of the foot elements on a leg side, at least one downward facing open slot is arranged and the at least one foot element is pivotable downwards and can be fitted at least in a downwardly pivoted position.

2. The chair as set forth in claim 1, wherein the at least one second spring arrangement is provided on the at least one holding member.

3. The chair as set forth in claim 2, wherein the at least one second spring arrangement is at least one piece of elastomer, against which a part of the at least one of the foot elements is spring mounted.

4. The chair as set forth in claim 2, wherein the at least one second spring arrangement has at least one tension/compression spring which is arranged on one of the leg part and the holding member and which is operative between at least one foot element and one of the leg part and the holding member.

5. The chair as set forth in claim 2, wherein at least one of the first and second spring arrangements is equipped with an adjusting device for adjusting elastic force.

6. The chair as set forth in claim 1, wherein on an end of the foot elements on a leg side, an abutment is formed on which at least one spring element of the spring second arrangement acts.

7. The chair as set forth in claim 1, wherein at least one of the plurality of foot elements includes means for restricting uncontrolled translatory movement of the rocker seat.

8. The chair as set forth in claim 7, wherein the restricting means comprise a stopper which, at a pre-determined inclination of the at least one of the plurality of foot elements is adapted to touch a floor and due to friction with the floor prevents the uncontrolled translatory movement of the rocker seat.

9. The chair as set forth in claim 8, wherein the stopper is coupled by an actuator/pivot connection with one of a roller and the at least one of the plurality of foot elements and, at a predetermined inclination of the at least one of the plurality of foot elements, is adapted to be pressed to the floor.

10. The chair as set forth in claim 8, wherein the stopper is rigidly disposed on an outer end of the at least one of the plurality of foot elements and lies radially outside of the circumference on which rollers are arranged.

* * * * *